US011041663B2

(12) United States Patent
Oh et al.

(10) Patent No.: US 11,041,663 B2
(45) Date of Patent: Jun. 22, 2021

(54) REFRIGERATOR

(71) Applicant: LG Electronics Inc., Seoul (KR)

(72) Inventors: Minkyu Oh, Seoul (KR); Heayoun Sul, Seoul (KR); Hyoungkeun Lim, Seoul (KR); Seokhyun Kim, Seoul (KR); Jeehoon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 72 days.

(21) Appl. No.: 16/494,192

(22) PCT Filed: Dec. 29, 2017

(86) PCT No.: PCT/KR2017/015743
§ 371 (c)(1),
(2) Date: Sep. 13, 2019

(87) PCT Pub. No.: WO2018/169178
PCT Pub. Date: Sep. 20, 2018

(65) Prior Publication Data

US 2020/0018526 A1 Jan. 16, 2020

(30) Foreign Application Priority Data

Mar. 15, 2017 (KR) ..... 10-2017-0032649

(51) Int. Cl.
*F25B 21/02* (2006.01)
*F25D 11/00* (2006.01)
(Continued)

(52) U.S. Cl.
CPC ..... *F25B 21/02* (2013.01); *F25D 11/00* (2013.01); *F25D 17/062* (2013.01);
(Continued)

(58) Field of Classification Search
CPC .. F25B 21/02; F25B 21/04; F25B 2321/0251; F25B 47/02; F25D 11/00; F25D 17/042;
(Continued)

(56) References Cited

U.S. PATENT DOCUMENTS 7,934,384 B2 * 5/2011 Tuskiewicz ..... A47F 3/0404 62/3.2
9,605,888 B2 * 3/2017 Shin ..... F25D 11/00
(Continued)

FOREIGN PATENT DOCUMENTS

JP H10300305 11/1998
JP 2004340403 12/2004
(Continued)

OTHER PUBLICATIONS

Chinese Office Action in Chinese Application No. 20178088190.9, dated Sep. 27, 2020, 9 pages (with English translation).
(Continued)

*Primary Examiner* — Filip Zec
(74) *Attorney, Agent, or Firm* — Fish & Richardson P.C.

(57) ABSTRACT

A refrigerator includes a thermoelectric element module, and a defrosting temperature sensor, and a controller configured to control operation of the thermoelectric element module. The thermoelectric element module includes a thermoelectric element including a heat absorption portion and a heat dissipation portion, a first heat sink in contact with the heat absorption portion, a first fan facing the first heat sink, a second heat sink in contact with the heat dissipation portion, and a second fan facing the second heat sink. The controller is configured to initiate a natural defrosting operation for removing frost on the thermoelectric element module at every preset period, and terminate the natural defrosting operation based on a temperature measured by the defrosting temperature sensor corresponding to a reference
(Continued)

temperature. The controller is configured to control operation of the thermoelectric element and rotation of the first and second fans in the natural defrosting operation.

20 Claims, 10 Drawing Sheets

(51) Int. Cl.

| | |
|---|---|
| ***F25D 17/06*** | (2006.01) |
| ***F25D 21/00*** | (2006.01) |
| ***F25D 21/08*** | (2006.01) |
| ***F25D 29/00*** | (2006.01) |

(52) U.S. Cl.
CPC ..... *F25D 21/006* (2013.01); *F25D 21/08* (2013.01); *F25D 29/00* (2013.01); *F25D 2317/0682* (2013.01); *F25D 2600/02* (2013.01)

(58) Field of Classification Search
CPC ..... F25D 17/062; F25D 21/006; F25D 21/08; F25D 2317/0411; F25D 2317/0682; F25D 2600/02; F25D 2700/12; F25D 29/00
See application file for complete search history.

(56) References Cited

U.S. PATENT DOCUMENTS

| | | | | |
|---|---|---|---|---|
| 10,527,339 | B2 * | 1/2020 | Hunter | F25D 17/065 |
| 2003/0226363 | A1 * | 12/2003 | Lee | F25D 29/008 62/3.6 |
| 2005/0210884 | A1 | 9/2005 | Tuskiewicz et al. | |
| 2007/0193280 | A1 | 8/2007 | Tuskiewicz et al. | |
| 2009/0232186 | A1 | 9/2009 | Li et al. | |
| 2010/0328897 | A1 | 12/2010 | Ma et al. | |
| 2012/0047911 | A1 | 3/2012 | Bhavsar et al. | |
| 2012/0304667 | A1 | 12/2012 | Shin et al. | |
| 2017/0259956 | A1 * | 9/2017 | Hori | F25D 23/028 |

FOREIGN PATENT DOCUMENTS

| | | |
|---|---|---|
| JP | 2009008359 | 1/2009 |
| JP | 2010196923 | 9/2010 |
| KR | 19970002215 | 1/1997 |
| KR | 100140065 | 7/1998 |
| KR | 20040094045 | 11/2004 |
| KR | 20100057216 | 5/2010 |
| KR | 20120133287 | 12/2012 |
| KR | 20170018178 | 2/2017 |
| KR | 20180105572 | 9/2018 |
| RU | 2129745 | 4/1999 |
| RU | 24271 | 7/2002 |
| RU | 33212 | 6/2003 |

OTHER PUBLICATIONS

Russian Office Action in Russian Appln. No. 2019132421, dated Apr. 27, 2020, 11 pages (with English translation).
Japanese Notice of Allowance in JP Appln. No. 2019-550625, dated Feb. 2, 2021, 7 pages (with English translation).
EP Extended European Search Report in European Appln. No. 17901261.2, dated Mar. 4, 2021, 7 pages.

* cited by examiner

REFRIGERATOR

CROSS-REFERENCE TO RELATED APPLICATIONS

This application is a National Stage application under 35 U.S.C. § 371 of International Application No. PCT/KR2017/015743, filed on Dec. 29, 2017, which claims the benefit of Korean Application No. 10-2017-0032649, filed on Mar. 15, 2017. The disclosures of the prior applications are incorporated by reference in their entirety.

CROSS-REFERENCE TO RELATED APPLICATIONS

This application is a National Stage application under 35 U.S.C. § 371 of International Application No. PCT/KR2017/015743, filed on Dec. 29, 2017, which claims the benefit of Korean Application No. 10-2017-0032649, filed on Mar. 15, 2017. The disclosures of the prior applications are incorporated by reference in their entirety.

TECHNICAL FIELD

The present disclosure relates to a refrigerator having a thermoelectric element module and exhibiting high refrigeration performance with low noise.

BACKGROUND

A thermoelectric element refers to a device that can implement heat absorption and heat generation using a Peltier effect. For example, a thermoelectric device may use the Peltier effect in which a voltage applied to both ends of a device may cause an endothermic phenomenon on one side and an exothermic phenomenon on the other side depending on a direction of a current. The thermoelectric element may be used in a refrigerator instead of a refrigerating cycle device.

A refrigerator may include a food storage space capable of blocking heat penetrating from an outside by a cabinet filled with an insulating material and a door. In some examples, the refrigerator may include a refrigerating device including an evaporator for absorbing heat inside the food storage space and a heat dissipating device for dissipating collected heat to the outside of the food storage space to maintain the food storage space as a low temperature region, in which microorganisms cannot survive and proliferate, and to keep stored food for a long period of time without spoiling food.

In some examples, the refrigerator may be divided into a refrigerating chamber for storing food in a temperature region above zero degrees Celsius and a freezing chamber for storing food in a temperature region below zero degrees Celsius. In some cases, the refrigerator may be classified into a top freezer refrigerator including an upper freezing chamber and a lower refrigerating chamber, a bottom freezer refrigerator having a lower freezing chamber and an upper refrigerating chamber, and a side by side refrigerator having a left freezing chamber and a right refrigerating chamber depending on an arrangement of the refrigerating chamber and the freezing chamber.

The refrigerator may include a plurality of shelves, drawers, and the like, in the food storage space so that a user may conveniently store or takeout food stored in the food storage space.

In some examples, where the refrigerating device for cooling the food storage space is implemented as a refrigerating cycle device including a compressor, a condenser, an expander, an evaporator, etc., noise and vibration may be generated in the compressor. In some cases, an installation place of a refrigerator such as a cosmetic refrigerator is not limited to a kitchen but may be extended to a living room or a bedroom. If noise and vibration are not fundamentally blocked or reduced, a user may feel inconvenience of the refrigerator.

In some examples, where the thermoelectric element is applied to the refrigerator, a food storage space may be cooled without a refrigerating cycle device. In particular, the thermoelectric element may not generate noise and vibration in comparison to a compressor. Therefore, if the thermoelectric element is applied to the refrigerator, noise and vibration may be eliminated or reduced so that a refrigerator may be installed in a space other than the kitchen.

In some examples, the thermoelectric element may be used for cooling an ice making chamber. In some cases, a refrigerator may be operated by a control method of a refrigerator having a thermoelectric element.

In some cases, cooling power obtained by using the thermoelectric element may be less than that of the refrigerating cycle device. In addition, the thermoelectric element may have inherent characteristics that are distinct from the refrigerating cycle device. In some cases, a refrigerator having a thermoelectric element may use a cooling operation method different from that of a refrigerator having the refrigerating cycle device.

SUMMARY

The present disclosure describes a control method suitable for a refrigerator including a thermoelectric element and a fan in consideration of characteristics of a thermoelectric element that performs cooling or heating according to a polarity of a voltage, and a refrigerator controlled by the control method.

The present disclosure also describes a refrigerator for performing a defrosting operation based on a driving integration time of a thermoelectric element module, an external temperature of the refrigerator, a temperature of the thermoelectric element module, etc. to ensure reliability of the defrosting operation.

The present disclosure also describes a refrigerator capable of improving defrosting efficiency by complexly performing a natural defrosting operation to naturally remove frost and a heat source defrosting operation using a heat source.

The present disclosure further describes a refrigerator configured to terminate a defrosting operation based on a temperature condition so as to ensure reliability of the defrosting operation.

According to one aspect of the subject matter described in this application, a refrigerator includes: a door configured to open and close a storage chamber of the refrigerator; a thermoelectric element module configured to cool the storage chamber; a defrosting temperature sensor installed in the thermoelectric element module and configured to detect a temperature of the thermoelectric element module; and a controller configured to control operation of the thermoelectric element module. The thermoelectric element module includes: a thermoelectric element including a heat absorption portion and a heat dissipation portion, a first heat sink that is in contact with the heat absorption portion and that is configured to exchange heat with an inside of the storage chamber, a first fan that faces the first heat sink and that is configured to generate air flow to accelerate heat exchange of the first heat sink, a second heat sink that is in contact with the heat dissipation portion and that is configured to exchange heat with an outside of the storage chamber, and a second fan that faces the second heat sink and that is configured to generate air flow to accelerate heat exchange of the second heat sink. The controller is configured to: initiate a natural defrosting operation for removing frost deposited on the thermoelectric element module at every preset period determined based on an accumulated driving duration of the thermoelectric element module, and terminate the natural defrosting operation based on the temperature of the thermoelectric element module measured by the defrosting temperature sensor corresponding to a reference defrosting termination temperature. The controller is configured to, based on initiating the natural defrosting operation, (i) stop operation of the thermoelectric element, (ii) maintain rotation of the first fan, and (iii) stop rotation of the second fan for a preset time and then rotate the second fan after a lapse of the preset time.

Implementations according to this aspect may include one or more of the following features. For example, the refrigerator may further include an external air temperature sensor configured to measure an external temperature of the refrigerator, where the thermoelectric element is configured to cool the storage chamber based on a forward voltage. The controller may be further configured to: initiate a heat source defrosting operation based on the external temperature measured by the external air temperature sensor being less than or equal to a reference external temperature, and terminate the heat source defrosting operation based on the temperature of the thermoelectric element module measured by the defrosting temperature sensor corresponding to the reference defrosting termination temperature. The controller may be further configured to, based on initiating the heat source defrosting operation, apply a reverse voltage to the thermoelectric element and rotate both of the first fan and the second fan.

In some implementations, the thermoelectric element may be configured to cool the storage chamber based on a forward voltage. The controller may be further configured to: initiate a heat source defrosting operation based on the temperature of the thermoelectric element module measured by the defrosting temperature sensor being less than or equal to a reference thermoelectric element module temperature; and terminate the heat source defrosting operation based on the temperature of the thermoelectric element module measured by the defrosting temperature sensor corresponding to a temperature greater than the reference defrosting termination temperature by a preset threshold. The controller may be configured to, based on initiating the heat source defrosting operation, apply a reverse voltage to the thermoelectric element and rotate both of the first fan and the second fan.

In some examples, the preset period for determining the initiation of the natural defrosting operation may decrease based on an increase of an opening time of the door in which the door is opened. In some examples, the preset period for determining the initiation of the natural defrosting operation may be set to a value based on the door being opened, where the value is less than a prior value set before the opening of the door.

In some implementations, the controller may be further configured to initiate a load-responsive operation for decreasing the temperature of the storage chamber based on the temperature of the storage chamber being increased by a preset temperature within a preset time after the door is opened and then closed. In the same or other implementations, the preset period for determining the initiation of the natural defrosting operation may be set to a value based on initiation of the load-responsive operation, where the value is less than a prior value set before the initiation of the load-responsive operation.

In some implementations, the refrigerator may further include an internal temperature sensor configured to measure a temperature of the storage chamber. In the same or other implementations, the controller may be further configured to: determine a cooling rotation speed of the first fan and a cooling rotation speed of the second fan during a cooling operation for cooling the storage chamber based on a temperature condition of the storage chamber measured by the internal temperature sensor; rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan; and rotate the second fan at a second rotation speed (i) during the natural defrosting operation or (ii) during the heat source defrosting operation, the second rotation speed being greater than or equal to the cooling rotation speed of the second fan.

In some examples, the first rotation speed of the first fan during the natural defrosting operation or the heat source defrosting operation may be equal to a maximum rotation speed of the first fan during the cooling operation, and the second rotation speed of the second fan during the natural defrosting operation or the heat source defrosting operation may be equal to a maximum rotation speed of the second fan during the cooling operation.

In some implementations, the refrigerator may further include an internal temperature sensor configured to measure a temperature of the storage chamber. In the same implementations, the controller may be further configured to: determine a cooling rotation speed of the first fan and a cooling rotation speed of the second fan during a cooling operation for cooling the storage chamber based on a temperature condition of the storage chamber measured by the internal temperature sensor; rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan; and rotate the second fan at a second rotation speed (i) during the natural defrosting operation or (ii) during the heat source defrosting operation, the second rotation speed being greater than or equal to the cooling rotation speed of the second fan.

In some implementations, the first rotation speed of the first fan during the natural defrosting operation or the heat source defrosting operation may be equal to a maximum rotation speed of the first fan during the cooling operation, and the second rotation speed of the second fan during the natural defrosting operation or the heat source defrosting operation may be equal to a maximum rotation speed of the second fan during the cooling operation.

In some implementation, the preset period for determining the initiation of the natural defrosting operation may vary based on whether or not the door is opened. In some examples, the preset period for determining the initiation of the natural defrosting operation may decrease based on an increase of an opening time of the door in which the door is opened. In some examples, the preset period for determining the initiation of the natural defrosting operation may be set to a value based on the door being opened, the value being less than a prior value set before the opening of the door.

According to another aspect, a refrigerator includes: a door configured to open and close a storage chamber of the refrigerator; a thermoelectric element module configured to cool the storage chamber; a defrosting temperature sensor installed in the thermoelectric element module and configured to detect a temperature of the thermoelectric element module; an external air temperature sensor configured to measure an external temperature of the refrigerator; and a controller configured to control operation of the thermoelectric element module. The thermoelectric element module includes: a thermoelectric element including a heat absorption portion and a heat dissipation portion and being configured to cool the storage chamber based on a forward voltage, a first heat sink that is in contact with the heat absorption portion and that is configured to exchange heat with an inside of the storage chamber, a first fan that faces the first heat sink and that is configured to generate air flow to accelerate heat exchange of the first heat sink, a second heat sink that is in contact with the heat dissipation portion and that is configured to exchange heat with an outside of the storage chamber, and a second fan that faces the second heat sink and that is configured to generate air flow to accelerate heat exchange of the second heat sink. The controller is configured to: initiate a natural defrosting operation for removing frost deposited on the thermoelectric element module at every preset period determined based on an accumulated driving duration of the thermoelectric element module; and terminate the natural defrosting operation based on the temperature of the thermoelectric element module measured by the defrosting temperature sensor corresponding to a reference defrosting termination temperature. The controller is further configured to, based on initiating the natural defrosting operation, (i) stop operation of the thermoelectric element and (ii) rotate both of the first fan and the second fan. The preset period for determining the initiation of the natural defrosting operation varies based on whether or not the door is opened. The controller is further configured to: initiate a heat source defrosting operation based on the external temperature measured by the external air temperature sensor being less than or equal to a reference external temperature, and terminate the heat source defrosting operation based on the temperature of the thermoelectric element module measured by the defrosting temperature sensor corresponding to the reference defrosting termination temperature. The controller is configured to, based on initiating the heat source defrosting operation, apply a reverse voltage to the thermoelectric element and rotate both of the first fan and the second fan.

Implementations according to this aspect may include one or more of the following features. For example, the refrigerator may further include an internal temperature sensor configured to measure a temperature of the storage chamber. The controller may be further configured to: determine a cooling rotation speed of the first fan and a cooling rotation speed of the second fan during a cooling operation for cooling the storage chamber based on a temperature condition of the storage chamber measured by the internal temperature sensor; rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan; and rotate the second fan at a second rotation speed (i) during the natural defrosting operation or (ii) during the heat source defrosting operation, the second rotation speed being greater than or equal to the cooling rotation speed of the second fan.

In some examples, the first rotation speed of the first fan during the natural defrosting operation or the heat source defrosting operation may be equal to a maximum rotation speed of the first fan during the cooling operation, and the second rotation speed of the second fan during the natural defrosting operation or the heat source defrosting operation may be equal to a maximum rotation speed of the second fan during the cooling operation.

According to another aspect, a refrigerator includes: a door configured to open and close a storage chamber of the refrigerator; a thermoelectric element module configured to cool the storage chamber; a defrosting temperature sensor installed in the thermoelectric element module and configured to detect a temperature of the thermoelectric element module; and a controller configured to control operation of the thermoelectric element module. The thermoelectric element module includes: a thermoelectric element including a heat absorption portion and a heat dissipation portion and being configured to cool the storage chamber based on a forward voltage, a first heat sink that is in contact with the heat absorption portion and that is configured to exchange heat with an inside of the storage chamber, a first fan that faces the first heat sink and that is configured to generate air flow to accelerate heat exchange of the first heat sink, a second heat sink that is in contact with the heat dissipation portion and that is configured to exchange heat with an outside of the storage chamber, and a second fan that faces the second heat sink and that is configured to generate air flow to accelerate heat exchange of the second heat sink. The controller is configured to: initiate a natural defrosting operation for removing frost deposited on the thermoelectric element module at every preset period determined based on an accumulated driving duration of the thermoelectric element module; and terminate the natural defrosting operation based on the temperature of the thermoelectric element module measured by the defrosting temperature sensor corresponding to a reference defrosting termination temperature. The controller is further configured to, based on initiating the natural defrosting operation, (i) stop operation of the thermoelectric element and (ii) rotate both of the first fan and the second fan, where the preset period for determining the initiation of the natural defrosting operation varies based on whether or not the door is opened. The controller is further configured to: initiate a heat source defrosting operation based on the temperature of the thermoelectric element module measured by the defrosting temperature sensor being less than or equal to a reference thermoelectric element module temperature; and terminate the heat source defrosting operation based on the temperature of the thermoelectric element module measured by the defrosting temperature sensor corresponding to a temperature greater than the reference defrosting termination temperature by a preset threshold. The controller is further configured to, based on initiating the heat source defrosting operation, apply a reverse voltage to the thermoelectric element and rotate both of the first fan and the second fan.

Implementations according to this aspect may include one or more of the following features. For example, the refrigerator may further include an internal temperature sensor configured to measure a temperature of the storage chamber, where the controller is further configured to: determine a cooling rotation speed of the first fan and a cooling rotation speed of the second fan during a cooling operation for cooling the storage chamber based on a temperature condition of the storage chamber measured by the internal temperature sensor; rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan; and rotate the second fan at a second rotation speed (i) during the natural defrosting operation or (ii) during the heat source defrosting operation, the second rotation speed being greater than or equal to the cooling rotation speed of the second fan.

In some examples, the first rotation speed of the first fan during the natural defrosting operation or the heat source defrosting operation may be equal to a maximum rotation speed of the first fan during the cooling operation, and the second rotation speed of the second fan during the natural defrosting operation or the heat source defrosting operation may be equal to a maximum rotation speed of the second fan during the cooling operation.

In some implementations, the defrosting operation may be performed by the driving integration time of the thermoelectric element module and a defrosting period may be shorter than the original defrosting period based on opening of the door or the like. Thus, a reliability of the defrosting operation may be improved.

In some implementations, the defrosting operation may be additionally operated based on an external temperature of the refrigerator measured by an external air temperature sensor or a temperature of the thermoelectric element module measured by the defrosting temperature sensor as well as based on the driving integration time of the thermoelectric element module. In the same or other implementations, the defrosting operation may be efficiently performed based on the several variables.

In some implementations, when rapid defrosting is not required, the natural defrosting operation may be performed to reduce power consumption, and when rapid defrosting is required, the heat source defrosting operation may be performed to maximize an effect of the defrosting operation.

In some implementations, the defrosting operation may be terminated based on a temperature of the thermoelectric element module measured by the defrosting temperature sensor, which may improve a reliability of the defrosting operation. In some examples, the defrosting operation may be terminated at a temperature higher than the original reference defrosting termination temperature at which the defrosting operation is terminated under an over-defrosting condition. In the same or other implementations, a blockage of a flow path of a heat sink due to over-defrosting may be avoided or reduced.

DETAILED DESCRIPTION

Hereinafter, one or more implementations of a refrigerator will be described in detail with reference to the drawings.

Figure 1:
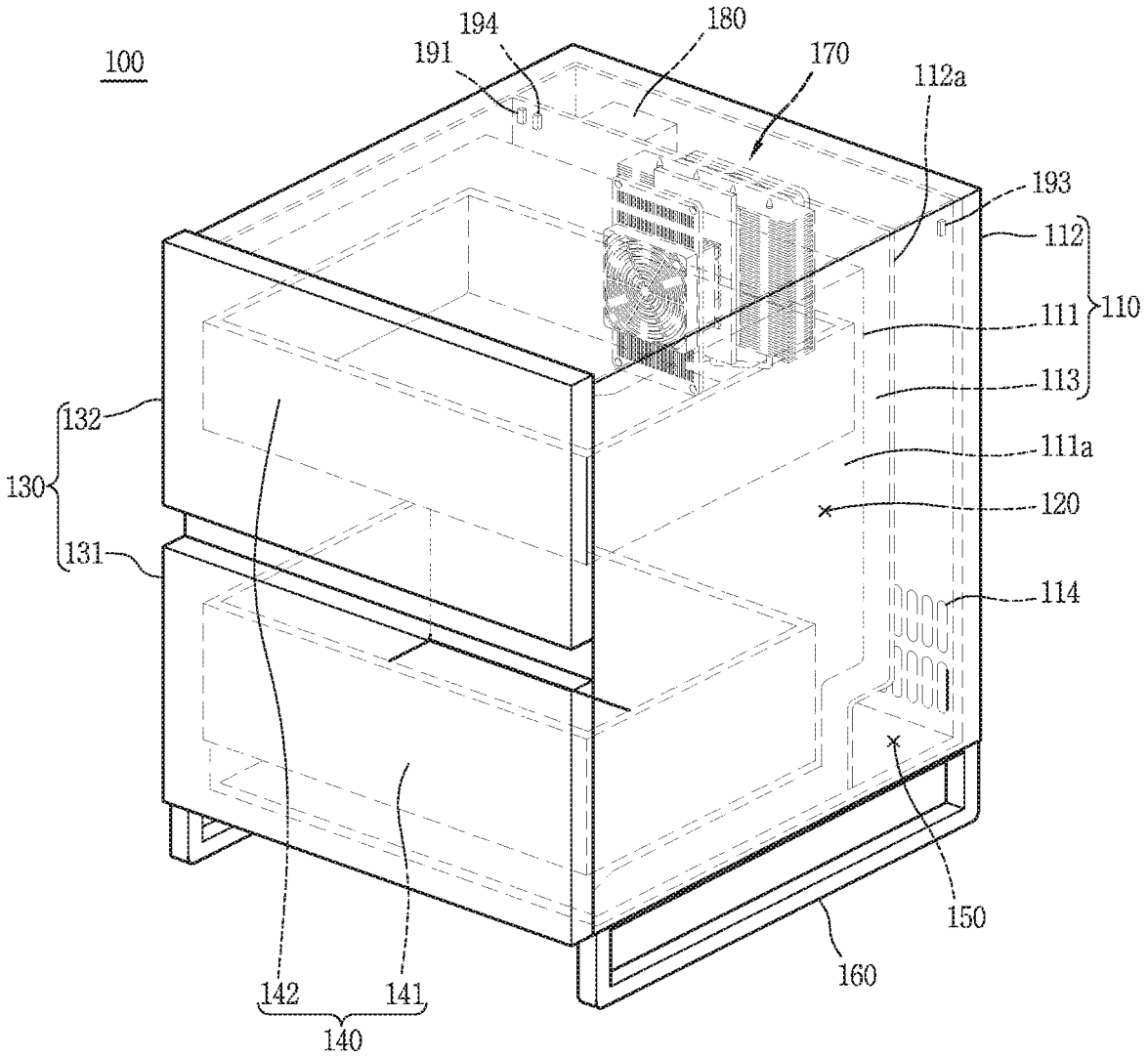
FIG. 1 is a conceptual view illustrating an example of a refrigerator having a thermoelectric element module.

FIG. 1 is a conceptual view illustrating an example of a refrigerator having a thermoelectric element module.

A refrigerator 100 may be configured to simultaneously perform functions of a small side table and a refrigerator 100. The small side table originally refers to a small table by a bed or on a side of a kitchen. The small side table is formed so that a desk lamp or the like may be placed on an upper surface thereof and allows a small stuff to be received therein. The refrigerator 100 of the present disclosure is capable of storing food and the like at low temperatures while maintaining the original function of the small side table, which allows a desk lamp or the like to be placed thereon.

Referring to FIG. 1, an outer appearance of the refrigerator 100 is formed by a cabinet 110 and a door 130.

The cabinet 110 is formed by an inner case 111, an outer case 112, and an insulating material 113.

The inner case 111 is provided inside the outer case 112 and forms a storage chamber 120 capable of storing food at a low temperature. The size of the storage chamber 120 formed by the inner case 111 should be limited to about 200 L or less because the size of the refrigerator 100 is limited in order for the refrigerator 100 to be used as a small table.

The outer case 112 forms an outer appearance of a small table shape. As the door 130 is installed on a front surface of the refrigerator 100, the outer case 112 forms an appearance of the remaining portion of the refrigerator 100 except for the front surface. In some implementations, an upper surface of the outer case 112 may be flat so as to allow a small item such as a desk lamp to be placed thereon.

The insulating material 113 is disposed between the inner case 111 and the outer case 112. The insulating material 113 is configured to suppress transfer of heat from a relatively hot outside to the relatively cold storage chamber 120.

The door 130 is mounted on a front portion of the cabinet 110. The door 130 forms an appearance of the refrigerator 100 together with the cabinet 110. The door 130 is configured to open and close the storage chamber 120 by a sliding movement. The door 130 may include two or more doors 131 and 132 in the refrigerator 100 and the doors 131 and 132 may be disposed along the vertical direction as shown in FIG. 1.

The storage chamber 120 may be provided with a drawer 140 for efficiently utilizing the space. The drawer 140 forms a food storage area in the storage chamber 120. The drawer 140 is coupled to the door 130 and is formed to be able to be drawn out from the storage chamber 120 according to the sliding movement of the door 130.

Two drawers 141 and 142 may be arranged along the vertical direction like the door 130. One drawer 141 is coupled to one door 131 and another drawer 142 is coupled to another door 132. Accordingly, the drawers 141 and 142 coupled to the doors 131 and 132 may be drawn out from the storage chamber 120 along the doors 131 and 132 each time the doors 131 and 132 slide.

A machine chamber 150 may be provided at a back of the storage chamber 120. The outer case 112 may be provided with a bulkhead (112*a*) to form the machine chamber 150. In this case, the insulating material 113 is disposed between the bulkhead (112*a*) and the inner case 111. All sorts of electrical equipment, mechanical equipment, etc. required for driving the refrigerator 100 may be installed in the machine chamber 150.

In some implementations, a support 160 may be installed on a bottom surface of the cabinet 110. The support 160, as illustrated in FIG. 1, is provided so that the cabinet 110 is disposed to be spaced from the floor where the refrigerator 100 is installed. A refrigerator 100 installed in a bedroom can be more frequently accessed by a user compared to a refrigerator 100 installed in a kitchen. In some implementations, the refrigerator 100 may be installed away from the floor, which makes it easier to remove dust accumulated between the refrigerator 100 and the floor. The support 160 allows the cabinet 110 to be disposed away from the floor where the refrigerator 100 is installed, which makes cleaning easier.

The refrigerator 100 may operate 24 hours a day, unlike other home appliances at home. In some examples, the refrigerator 100 may be placed next to a bed, and noise and vibration in the refrigerator 100, especially at night, may be transmitted to a person sleeping in the bed to interfere with sleep. Therefore, in order for the refrigerator 100 to be disposed beside the bed to simultaneously perform the function of the side table and the refrigerator 100, low noise and low vibration performance of the refrigerator 100 must be sufficiently secured.

If a refrigeration cycle device including a compressor is used for cooling the storage chamber 120 of the refrigerator 100, it may be difficult to block noise and vibration generated in the compressor. Therefore, in order to secure low noise and low vibration performance, the refrigeration cycle device may be used limitedly, and the refrigerator 100 may cool the storage chamber 120 using the thermoelectric element module 170.

The thermoelectric element module 170 may be installed on the rear wall 111*a* of the storage chamber 120 to cool the storage chamber 120. The thermoelectric element module 170 may include a thermoelectric element, and the thermoelectric element may implement cooling and heat generation using a Peltier effect. For example, the heat absorption side of the thermoelectric element may be disposed to face the storage chamber 120, and a heat generation side of the thermoelectric element may be disposed toward the outside of the refrigerator 100. The storage chamber 120 may be cooled through an operation of the thermoelectric element.

A controller 180 is configured to control the entire operation of the refrigerator 100. For example, the controller 180 may control output of the thermoelectric element or a fan disposed in the thermoelectric element module 170, and control an operation of all sorts of components provided in the refrigerator 100. The controller 180 may be consists of a printed circuit board (PCB) and a microcomputer. The controller 180 may be installed in the machine chamber 150, but not limited to this.

In case the thermoelectric element module 170 is controlled by the controller 180, the thermoelectric element output may be controlled based on a temperature of the storage chamber 120, a set temperature by a user, an external temperature of the refrigerator 100, and the like. A cooling operation, defrosting operation, load-responsive operation, and the like are controlled by the controller 180. The thermoelectric element output varies according to an operation determined by the controller 180.

The temperature of the storage chamber 120 or external temperature of the refrigerator, etc. may be measured by a sensor unit (e.g., sensors 191, 192, 193, 194, 195) provided in the refrigerator. The sensor unit may be formed as at least one device for measuring a physical property such as temperature sensors 191, 192, 193, a humidity sensor 194, an air pressure sensor 195. For instance, the temperature sensors 191, 192, 193 may be installed at the storage chamber 120, the thermoelectric element module 170, and the outer case 112, respectively, and measure a temperature of a region in which each sensor is installed.

The internal temperature sensor 191 may be installed in the storage chamber 120, and is configured to measure a temperature of the storage chamber 120. The defrosting temperature sensor 192 is installed at the thermoelectric element module 170, and is configured to measure a temperature of the thermoelectric element module 170. The outside air temperature sensor 193 is installed at the outer case 112, and is configured to measure an external temperature of the refrigerator 100.

The humidify sensor 94 may be installed in the storage chamber 120, and is configured to measure the amount of humidity in the storage chamber 120. The air pressure sensor 195 is installed at the thermoelectric element module 170 to measure air pressure of a first fan 173 (See FIG. 2).

A detailed configuration of the thermoelectric element module 170 will be described later with reference to FIG. 2.

Figure 2:
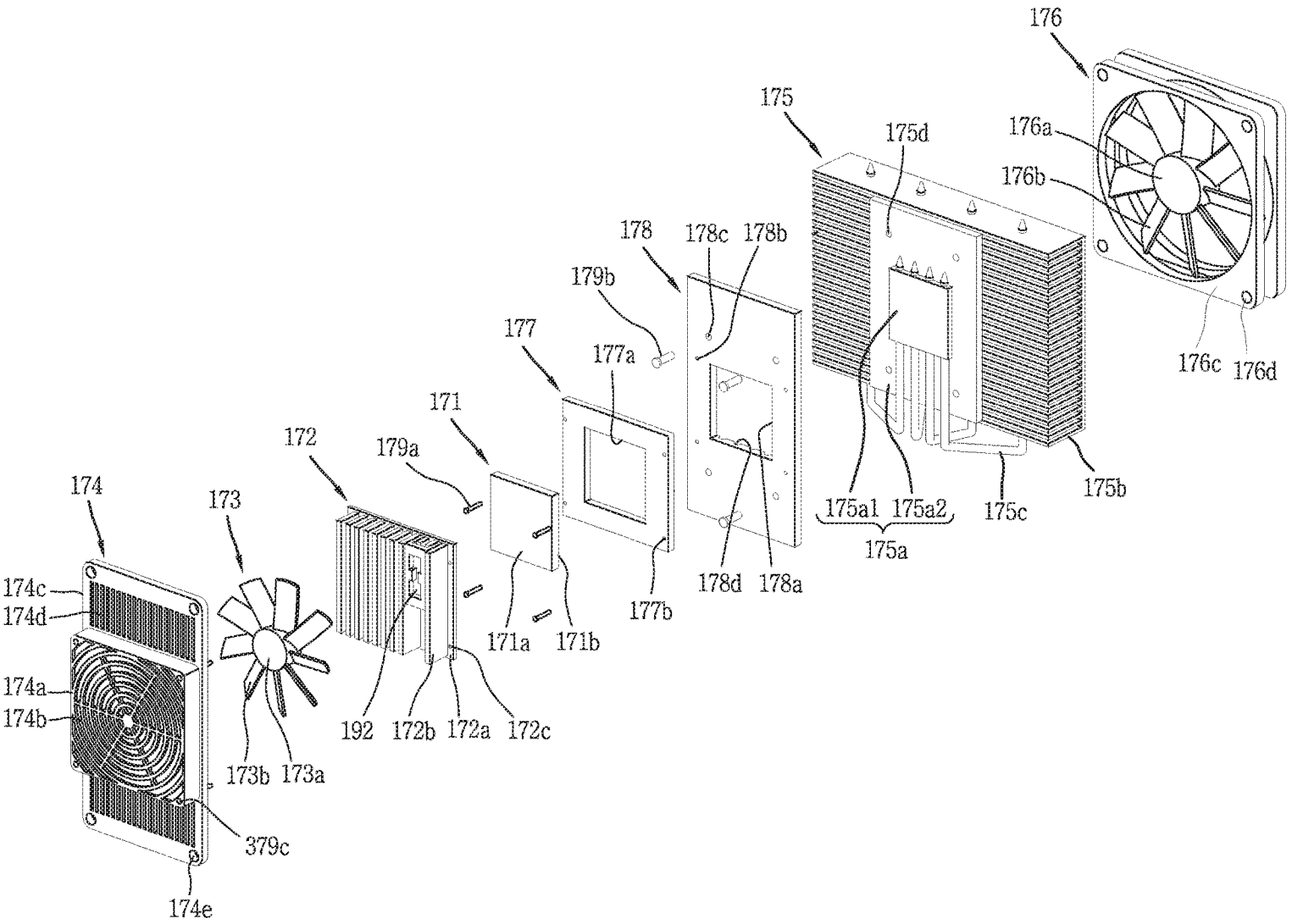
FIG. 2 is an exploded perspective view of an example of a thermoelectric element module.

FIG. 2 is an exploded perspective view of the thermoelectric element module.

The thermoelectric element module 170 includes a thermoelectric element 171, a first heat sink 172, a first fan 173, a second heat sink 175, a second fan 176, and an insulating material 177. The thermoelectric element module 170 operates between a first region and a second region that are distinguished from each other, and absorb heat in one region and dissipate heat in another region.

The first region and the second region indicate regions that are spatially distinguished from each other by a boundary. If the thermoelectric element module 170 is applied to the refrigerator (100 of FIG. 1), the first region corresponds to one of the storage chamber (120 of FIG. 1) and the outside of the refrigerator (100 of FIG. 1) and the second region corresponds to the other.

The thermoelectric element 171 has a PN junction with a P-type semiconductor and an N-type semiconductor and is formed by connecting a plurality of PN junctions in series.

The thermoelectric element 171 has a heat absorption portion 171*a* and a heat dissipation portion 171*b* facing in opposite directions. In some implementations, the heat absorption portion 171*a* and the heat dissipation portion 171*b* may be formed in a surface contactable manner for effective heat transfer. Therefore, the heat absorption portion 171*a* may be referred to as a heat absorption surface, and the heat dissipation portion 171*b* may be referred to as a heat dissipation surface. Further, the heat absorption portion 171*a* and the heat dissipation portion 171*b* may be generalized and named as a first portion and a second portion or a first surface and a second surface. This is for convenience of description only and does not limit the scope of the disclosure.

The first heat sink 172 is disposed in contact with the heat absorption portion 171*a* of the thermoelectric element 171. The first heat sink 172 is configured to exchange heat with the first region. The first region corresponds to the storage chamber (120 of FIG. 1) of the refrigerator (100 of FIG. 1), and an object to be heat-exchanged by the first heat sink 172 is air inside the storage chamber (120 of FIG. 1).

The first fan 173 is installed to face the first heat sink 172 and generates wind to accelerate the heat exchange of the first heat sink 172. Since heat exchange is a natural phenomenon, the first heat sink 172 may exchange heat with the air in the storage chamber (120 of FIG. 1) even without the first fan 173. However, as the thermoelectric element module 170 includes the first fan 173, the heat exchange of the first heat sink 172 may be further accelerated.

The first fan 173 may be covered by a cover 174. The cover 174 may include a portion other than a portion 174*a* covering the first fan 173. A plurality of holes 174*b* may be formed in the portion 174*a* covering the first fan 173 so that air in the storage chamber (120 of FIG. 1) may pass through the cover 174.

Further, the cover 174 may have a structure that may be fixed to the rear wall (111*a* of FIG. 1) of the storage chamber (120 of FIG. 1). For example, in FIG. 2, the cover 174 has a portion 174*c* extending from both sides of the portion 174*a* covering the first fan 173, and a screw fastener 174*e* through which a screw may be inserted in the extended portion 174*c*. In addition, since a screw 179*c* is inserted into a portion covering the first fan 173, the cover 174 may be further fixed to the rear wall (111*a* of FIG. 1) by the screw 179*c*. Holes 174*b* and 174*d* through which air may pass may be formed in the portion 174*a* covering the first fan 173 and the extended portion 174*c*.

The second heat sink 175 is arranged to be in contact with the heat dissipation portion 171*b* of the thermoelectric element 171. The second heat sink 175 is configured to exchange heat with the second region. The second region corresponds to the outer space of the refrigerator (100 of FIG. 1). The object to be heat-exchanged by the second heat sink 175 is air outside the refrigerator (100 of FIG. 1).

The second fan 176 is installed to face the second heat sink 175 and generates wind to accelerate heat exchange of the second heat sink 175. Promoting heat exchange of the second heat sink 175 by the second fan 176 is the same as promoting heat exchange of the first heat sink 172 by the first fan 173.

The second fan 176 may optionally include a shroud 176*c*. The shroud 176*c* is configured to guide wind. For example, the shroud 176*c* may be configured to enclose the vanes 176*b* at a location spaced from the vanes 176*b* as shown in FIG. 2. Further, a screw coupling hole 176*d* for fixing the second fan 176 may be formed on the shroud 176*c*.

The first heat sink 172 and the first fan 173 correspond to a heat absorption side of the thermoelectric element module 170. The second heat sink 175 and the second fan 176 correspond to a heat generation side of the thermoelectric element module 170.

At least one of the first heat sink 172 and the second heat sink 175 includes a bases 172*a* and 175*a* and fins 172*b* and 175*b*, respectively. Hereinafter, it is assumed that both the first heat sink 172 and the second heat sink 175 include the bases 172*a* and 175*a* and the fins 172*b* and 175*b*.

The bases 172*a* and 175*a* are in surface contact with the thermoelectric element 171. The base 172*a* of the first heat sink 172 is in surface contact with the heat absorption portion 171*a* of the thermoelectric element 171 and the base 175*a* of the second heat sink 175 is in contact with the heat dissipation portion 171*b* of the thermoelectric element 171.

It is ideal that the bases 172*a* and 175*a* and the thermoelectric element 171 are in surface contact with each other because thermal conductivity increases as a heat transfer area increases. Also, a heat conductor (thermal grease or a thermal compound) may be used to fill a fine gap between the bases 172*a* and 175*a* and the thermoelectric element 171 to increase thermal conductivity.

The fins 172*b* and 175*b* protrude from the bases 172*a* and 175*a* to exchange heat with air in the first region or with air in the second region. Since the first region corresponds to the storage chamber (120 in FIG. 1) and the second region corresponds to the outside of the refrigerator (100 in FIG. 1), the fins 172*b* of the first heat sink 172 are configured o exchange heat with the air of the storage chamber (120 in FIG. 1) and the fins 175*b* of the second heat sink 175 are configured to exchange heat with the outside air of the refrigerator (100 of FIG. 1).

The fins 172*b* and 175*b* are disposed to be spaced apart from each other. This is because a heat exchange area may increase as the fins 172*b* and 175*b* are spaced apart from each other. If the fins 172*b* and 175*b* adjoin, there is no heat exchange area between the fins 172*b* and 175*b*, but since the fins 172*b* and 175*b* are spaced art from each other, a heat exchange area may be present between the fins 172*b* and 175*b*. As the heat transfer area increases, thermal conductivity increases. Therefore, in order to improve heat transfer performance of the heat sink, the area of the fins exposed in the first region and the second region must be increased.

In order to implement a sufficient cooling effect of the first heat sink 172 corresponding to the heat absorption side, thermal conductivity of the second heat sink 175 corresponding to the heat generation side must be larger than that of the first heat sink 172. This is because heat absorption may be sufficiently made in the heat absorption portion 171*a* when heat dissipation is quickly made in the heat dissipation portion 171*b* of the thermoelectric element 171. This is because the thermoelectric element 171 is not simply a heat conductor but an element in which heat absorption is made at one side and heat dissipation is made at the other side as a voltage is applied. Therefore, sufficient cooling may be implemented at the heat absorption portion 171*a* when stronger heat dissipation must be performed at the heat dissipation portion 171*b* of the thermoelectric element 171.

In consideration of this, when heat absorption is made in the first heat sink 172 and heat dissipation is made in the second heat sink 175, a heat exchange area of the second heat sink 175 must be larger than a heat exchange area of the first heat sink 172. Assuming that the entire heat exchange area of the first heat sink 172 is used for heat exchange, the heat exchange area of the second heat sink 175 may be three times or more the heat exchange area of the first heat sink 172.

This principle is equally applied to the first fan 173 and the second fan 176 as well. In order to implement a sufficient cooling effect on the heat absorption side, an air volume and an air velocity formed by the second fan 176 may be larger than an air volume and an air velocity formed by the first fan 173.

As the second heat sink 175 requires a larger heat exchange area than the first heat sink 172, the areas of the base 175*a* and the fins 175*b* of the second heat sink 175 may be larger than those of the base 172*a* and the fins 172*b* of the first heat sink 172. Further, the second heat sink 175 may be provided with a heat pipe 175*c* to rapidly distribute heat transferred to the base 175*a* of the second heat sink 175 to the fins.

The heat pipe 175*c* is configured to receive a heat transfer fluid therein, and one end of the heat pipe 175*c* passes through the base 175*a* and the other end passes through the fins 175*b*. The heat pipe 175*c* is a device that transfers heat from the base 175*a* to the fins 175*b* through evaporation of the heat transfer fluid accommodated therein. Without the heat pipe 175*c*, heat exchange may be concentrated only at adjacent fins 175*b* of base 175*a*. This is because heat is not sufficiently distributed to the fins 175*b* that are far from the base 175*a*.

In some implementations, as the heat pipe 175*c* is present, heat exchange may be made at all of the fins 175*b* of the second heat sink 175. This is because the heat of the base 175*a* may be evenly distributed to the fins 175*b* disposed relatively far from the base 175*a*.

The base 175*a* of the second heat sink 175 may be formed as two layers 175*a*1 and 175*a*2 to house the heat pipe 175*c*. The first layer 175*a*1 of the base 175*a* surrounds one side of the heat pipe 175*c* and the second layer 175*a*2 surrounds the other side of the heat pipe 175*c*. The two layers 175*a*1 and 175*a*2 may be arranged to face each other.

The first layer 175*a*1 may be disposed to be in contact with the heat dissipation portion 171*b* of the thermoelectric element 171 and may have a size which is the same as or similar to that of the thermoelectric element 171. The second layer 175*a*2 is connected to the fins 175*b*, and the fins 175*b* protrude from the second layer 175*a*2. The second layer 175*a*2 may have a larger size than the first layer 175*a*1. One end of the heat pipe 175*c* is disposed between the first layer 175*a*1 and the second layer 175*a*2.

The insulating material 177 is installed between the first heat sink 172 and the second heat sink 175. The insulating material 177 is formed to surround the edge of the thermoelectric element 171. For example, as shown in FIG. 2, a hole 177*a* may be formed in the insulating material 177, and a thermoelectric element 171 may be disposed in the hole 177*a*.

As described above, the thermoelectric element module 170 is a device which implements cooling of the storage chamber (120 in FIG. 1) through heat absorption and heat dissipation at one side and the other side of the thermoelectric element 171, and is not a simple heat conductor. In some examples, heat of the first heat sink 172 may not be directly transmitted to the second heat sink 175. In some cases, if a temperature difference between the first heat sink 172 and the second heat sink 175 is reduced due to direct heat transfer, performance of the thermoelectric element 171 is deteriorated. In order to prevent such a phenomenon, the insulating material 177 is configured to block direct heat transfer between the first heat sink 172 and the second heat sink 175.

A fastening plate 178 is disposed between the first heat sink 172 and the insulating material 177 or between the second heat sink 175 and the insulating material 177. The fastening plate 178 is for fixing the first heat sink 172 and the second heat sink 175. The first heat sink 172 and the second heat sink 175 may be screwed to the fastening plate 178.

The fastening plate 178 may be formed to surround the edge of the thermoelectric element 171 together with the insulating material 177. The fastening plate 178 has a hole 178*a* corresponding to the thermoelectric element 171 like the insulating material 177 and the thermoelectric element 171 may be disposed in the hole 178*a*. However, the fastening plate 178 is not an essential component of the thermoelectric element module 170, and may be replaced with any other component capable of fixing the first heat sink 172 and the second heat sink 175.

The fastening plate 178 may be formed with a plurality of screw fastening holes 178*b* and 178*c* for fixing the first and second heat sinks 172 and 175. The first heat sink 172 and the insulating material 177 are formed with screw fastening holes 172*c* and 177*b* corresponding to the fastening plate 178 and a screw 179*a* is sequentially fastened to the three screw fastening holes 172*c*, 177*b*, and 178*b* to fix the first heat sink 172 to the fastening plate 178. The second heat sink 175 is also provided with a screw fastening hole 175*d* corresponding to the fastening plate 178 and a screw 179*b* may be sequentially inserted into the two screw fastening holes 178*c* and 175*d* to fix the second heat sink 175 to the fastening plate 178.

The fastening plate 178 may be provided with a recess portion 178*d* adapted to accommodate one side of the heat pipe 175*c*. The recess portion 178*d* may be formed corresponding to the heat pipe 175*c* and may be partially surround it. Even though the second heat sink 175 has the heat pipe 175*c*, since the fastening plate 178 has the recess portion 178*d*, the second heat sink 175 may be brought into close contact with the fastening plate 178 and the entire thickness of the thermoelectric element module 170 may be reduced to be thinner.

At least one of the first fan 173 and the second fan 176 described above includes hubs 173*a* and 176*a* and vanes 173*b* and 176*b*. Hubs 173*a* and 176*a* are coupled to a rotation center shaft (not shown). The vanes 173*b* and 176*b* are radially installed around the hubs 173*a* and 176*a*.

The axial flow fans 173 and 176 are separated from a centrifugal fan. The axial flow fans 173 and 176 are configured to generate wind in the direction of a rotating shaft, and air flows in and out the direction of the rotating shaft of the axial flow fans 173 and 176. In some cases, the centrifugal fan may generate wind in a centrifugal direction (or in a circumferential direction), and air flows in the direction of a rotating shaft of the centrifugal fan and flows out in the centrifugal direction.

The defrosting temperature sensor 192 is mounted in the thermoelectric element module and is configured to measure a temperature of the thermoelectric element module 170. Referring to FIG. 2, the defrosting temperature sensor 192 is coupled to the first heat sink 172. The structure of the defrosting temperature sensor 192 will be described with reference to FIGS. 3 and 4.

Figure 3:
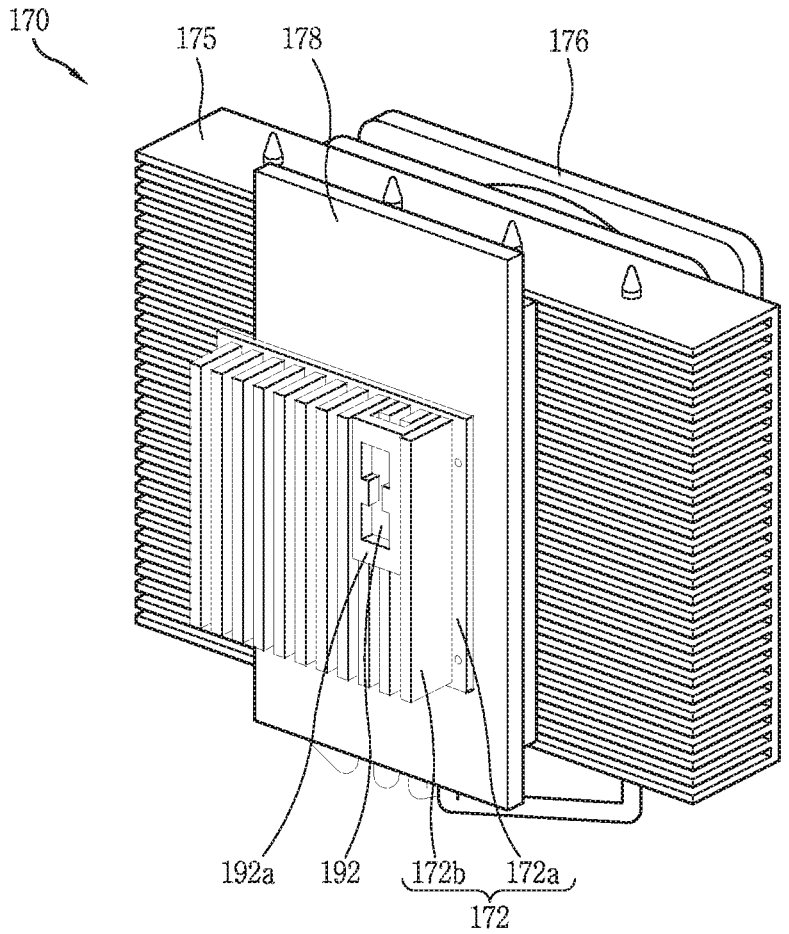
FIG. 3 is a perspective view of an example of a thermoelectric element module and an example of a defrosting temperature sensor.
Figure 4:
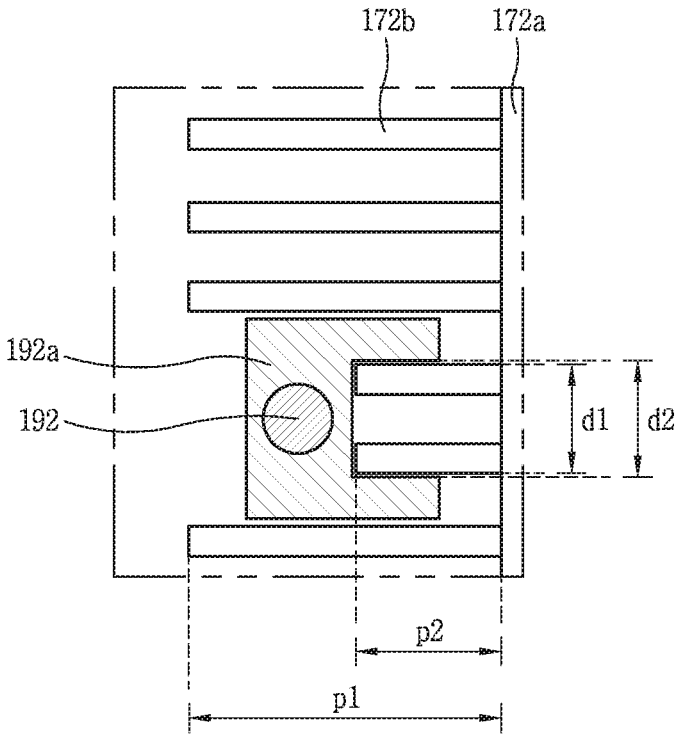
FIG. 4 is a plan view of the thermoelectric element module and the defrosting temperature sensor shown in FIG. 3.

FIG. 3 is a perspective view of the thermoelectric element module and the defrosting temperature sensor 192. FIG. 4 is a plan view of the thermoelectric element module 170 and the defrosting temperature sensor 192 shown in FIG. 3.

The defrosting temperature sensor 192 is coupled to the fins 172*b* of the first heat sink 172. The fins 172*b* of the first heat sink 172 protrude from the base 172*a*, some of which have a shorter protrusion length p2 than the other fins.

The defrosting temperature sensor 192 is wrapped by the sensor holder 192*a* and the sensor holder 192*a* has a shape that may be fitted to a fin having a shorter protrusion length than other fins. FIG. 3 shows a structure in which both legs of the sensor holder 192*a* are fitted to two fins. The sensor holder 192*a* may be fitted to the two fins if a distance d2 between both legs of the sensor holder 192*a* is smaller than a distance d1 between outer surfaces of the two fins.

A position of the defrosting temperature sensor 192 is selected to be a position where a temperature rise is taken for the longest time in the first heat sink 172 during a defrosting operation, whereby reliability of the defrosting operation may be improved. The position of the defrosting temperature sensor 192 is determined by a position of the sensor holder 192*a*.

In some examples, since the fin disposed at the center in the first heat sink 172 is closest to the base 172*a*, a temperature may rise rapidly during the defrosting operation. In some cases, since the fins disposed on an outer side in the first heat sink 172 are far from the base 172*a*, a temperature may rise slowly during the defrosting operation.

In some examples, the outermost fin may be affected not only by the thermoelectric element module 170 but also by air outside the thermoelectric element module 170. In some implementations, the sensor holder 192*a* may be coupled to a fin immediately on an inner side of the outermost fin. In some implementations, an up-down position of the sensor holder 192*a* may be the uppermost position or the lowermost position of the fin, and in FIG. 3, the sensor holder 192*a* is shown to be coupled at the uppermost position of the fin.

The sensor holder 192*a* may be fitted to the fin even though a protruding length of the fin is constant. However, when the length of the fin is constant, accurate temperature measurement is difficult because the defrosting temperature sensor 192 is separated from the base 172*a* too far. Therefore, the protrusion length p2 of the fin to which the sensor holder 192*a* is coupled may be shorter than the protrusion length p1 of the other fin.

Figure 5:
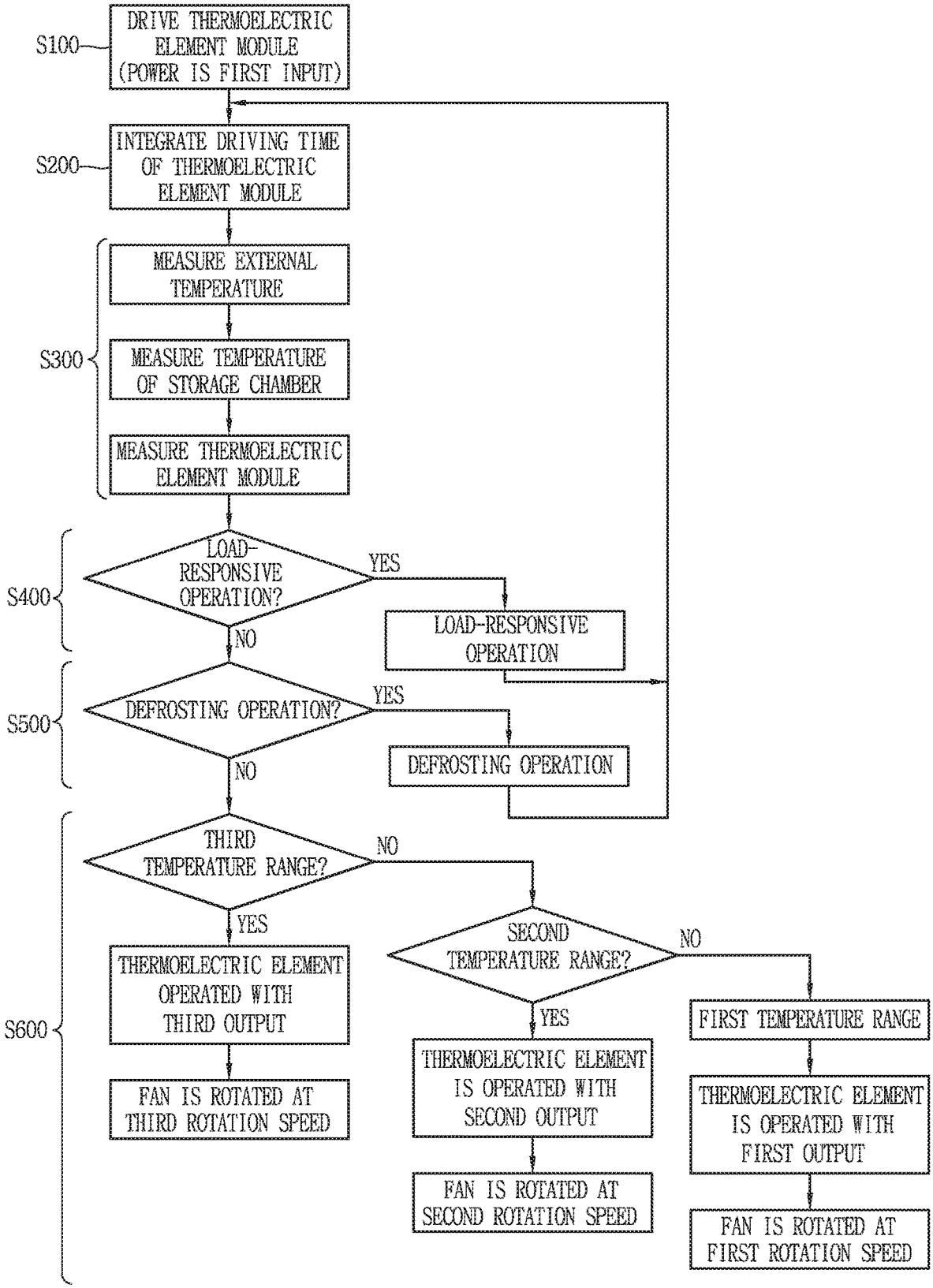
FIG. 5 is a flowchart showing an example a control method of a refrigerator.

FIG. 5 is a flowchart showing an example of a control method of a refrigerator.

In step S100, first, the thermoelectric element module starts a cooling operation when power is supplied for the reason of first power input, or the like. The power of the thermoelectric element module may be shut off due to natural defrosting or the like. Therefore, when the thermoelectric element module is powered on again after natural defrosting is terminated, the thermoelectric element module resumes the cooling operation.

In step S200, a driving time of the thermoelectric element module is integrated. The term "integration" may refer to cumulatively counting the driving time of the thermoelectric element module. For example, a plurality of intermittent driving times (i.e., durations) of the thermoelectric element module may be added together to determine an accumulated driving duration. In some examples, a continuous driving duration may correspond to an accumulated driving duration. The integration of the driving time of the thermoelectric element module may continue during the control process of the refrigerator and is a basis for inputting the defrosting operation.

In step S300, an external temperature of the refrigerator, a temperature of the storage chamber, and a temperature of the thermoelectric element module are measured. The temperatures measured in this step may be used to control an output of the thermoelectric element or an output of the fan in the controller together with a set temperature input by the user.

In step S400, it is determined whether or not a load-responsive operation is necessary. Load-responsive operation corresponds to an operation of rapidly cooling the storage chamber as hot food or the like is put into the storage chamber of the refrigerator. The basis for determining the necessity of the load-responsive operation will be described later. When it is determined that the load-responsive operation is necessary, the load-responsive operation is started so that the thermoelectric element is operated with a preset output and the fan is rotated at a preset rotation speed. If it is determined that the load-responsive operation is not necessary, the next step is performed.

In step S500, the necessity of defrosting operation is determined. The defrosting operation refers to an operation of preventing frost from being deposited on the thermoelectric element module or removing deposited frost. Similarly, the basis for determining the necessity of the defrosting operation will be described later. When the defrosting operation is determined to be necessary, the defrosting operation is started so that the thermoelectric element is operated with a preset output, and the fan is rotated at a preset rotation speed. However, in the case of natural defrosting, power supplied to the thermoelectric element may be cut off. If it is determined that the defrosting operation is not necessary, a next step is performed.

In step S600, since the load-responsive operation and the defrosting operation precede the cooling operation, when the load-responsive operation and the defrosting operation are determined as not necessary, the cooling operation is started. The cooling operation is controlled based on a temperature of the storage chamber and a temperature input by the user. A result of the control appears as an output of the thermoelectric element and an output of the fan.

In some implementations, the output of the thermoelectric element is determined based on a temperature of the storage chamber, a set temperature input by the user, and an external temperature of the refrigerator. In some implementations, a rotation speed of the fan is determined based on a temperature of the storage chamber. Here, the fan may include at least one of the first fan or the second fan of the thermoelectric element module.

For example, in the flowchart of FIG. 5, if the temperature of the storage chamber corresponds to the third temperature range, the thermoelectric element is operated with a third output and the fan is rotated at a third rotation speed. If the temperature of the storage chamber corresponds to the second temperature range, the thermoelectric element is operated with a second output and the fan is rotated at a second rotation speed. If the temperature of the storage chamber corresponds to a first temperature range, the thermoelectric element is operated with the first output and the fan is rotated at the first rotation speed.

The output of the thermoelectric element and the rotation speed of the fan are relative concepts, and a detailed configuration thereof will be described later.

Hereinafter, control of the thermoelectric element and the fan according to each temperature range will be described with reference to FIG. 6 and Table 1. However, the numerical values in the figures and tables are only examples for explaining the concept of the present disclosure, and they are not limited to the values for the control method proposed in the present disclosure.

Figure 6:
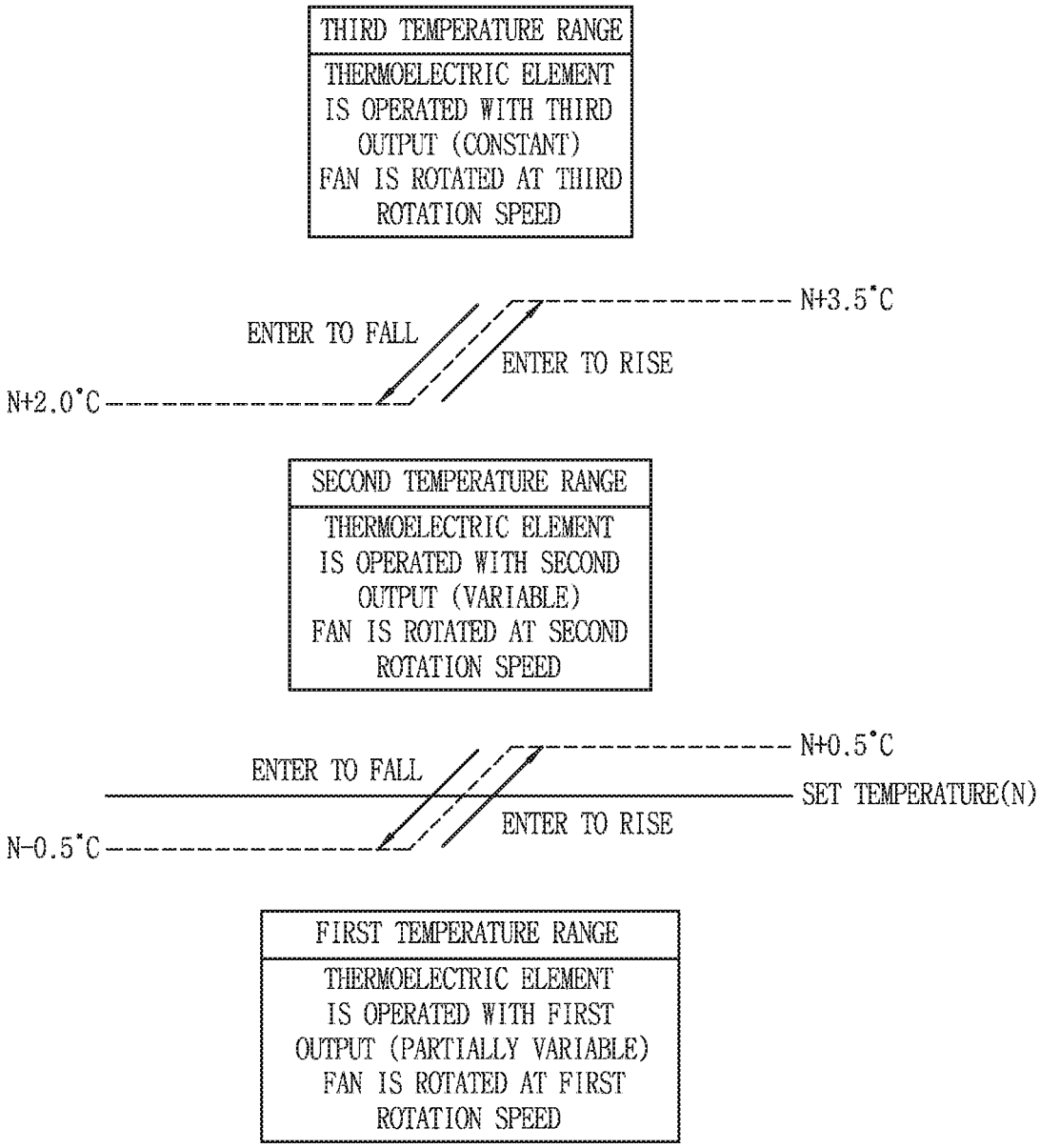
FIG. 6 is a conceptual diagram for explaining an example of a control method of a refrigerator based on one of a first temperature range to a third temperature range of a storage chamber.

FIG. 6 is a conceptual diagram for explaining an example of a control method of a refrigerator based on a first temperature range to a third temperature range. A temperature of the storage chamber may correspond to one of the first temperature range to the third temperature range.

The temperature of the storage chamber may be divided into a first temperature range, a second temperature range, and a third temperature range. Here, the first temperature range is a range including the set temperature input by the user. The second temperature range is a range of temperature higher than the first temperature range. The third temperature range is a range of temperature higher than the second temperature range. Accordingly, the temperature gradually increases from the first temperature range to the third temperature range.

In some examples, where the first temperature range includes the set temperature input by the user, if the temperature of the storage chamber is in the first temperature range, the temperature of the storage chamber has already lowered to the set temperature due to the operation of the thermoelectric element module. Therefore, the first temperature range is a range that satisfies the set temperature.

The second temperature range and the third temperature range may correspond to unsatisfactory ranges that do not satisfy the set temperature because these temperature ranges are higher than the set temperature input by the user. Therefore, at the second temperature range and the third temperature range, the thermoelectric element module should be operated to lower the temperature of the storage chamber to the set temperature. However, since the third temperature range corresponds to a temperature higher than the second temperature range, it is a range requiring more powerful cooling. In order to distinguish the second temperature range and the third temperature range from each other, the second temperature range may be referred to as the unsatisfactory range and the third temperature range may be referred to as an upper limit range.

The boundary of each temperature range depends on whether the temperature of the storage chamber is in rising or falling entry. For example, in FIG. 6, a rising entry temperature at which a temperature of the storage chamber rises to enter the second temperature range from the first temperature range is N+0.5° C. In some examples, a falling entry temperature at which the temperature of the storage chamber falls to enter the first temperature range from the second temperature range is N−0.5° C. Therefore, the rising entry temperature is higher than the falling entry temperature.

The rising entry temperature (N+0.5° C.) at which the temperature of the storage chamber enters the second temperature range from the first temperature range may be higher than the set temperature N input by the user. The falling entry temperature (N−0.5° C.) at which the temperature of the storage chamber enters the first temperature range from the second temperature range may be lower than the set temperature N input by the user.

Similarly, a rising entry temperature at which the temperature of the storage chamber rises to enter the third temperature range from the second temperature range in FIG. 6 is N+3.5° C. A falling entry temperature at which the temperature of the storage chamber is lowered to enter the second temperature range from the third temperature range may be N+2.0° C. Therefore, the rising entry temperature is higher than the falling entry temperature.

If the rising entry temperature is equal to the falling entry temperature, the control of the thermoelectric element or the fan is changed again without the storage chamber being sufficiently cooled. For example, if the set temperature of the storage chamber is satisfied as soon as the temperature of the storage chamber enters the first temperature range from the second temperature range and the thermoelectric element and the fan are stopped, the temperature of the storage chamber immediately enters the second temperature range again. In order to prevent this phenomenon and keep the temperature of the storage chamber sufficiently in the first temperature range, the falling entry temperature must be lower than the rising entry temperature.

Here, first, the output of the thermoelectric element and the rotation speed of the fan at an arbitrary set temperature will be described. Next, a change in control according to the set temperature will be described.

The output of the thermoelectric element at an arbitrary set temperature N1 is shown in Table 1. In Table 1, in a hot/cool item, when one surface of the thermoelectric element in contact with the first heat sink corresponds to a heat absorbing surface which is performing heat absorption, it is indicated as cool, and when the one surface corresponds to a heat dissipation surface which performs heat dissipation, it is indicated as hot. Also, RT indicates external temperature (room temperature) of the refrigerator.

TABLE 1

| Order | Condition (first set temperature, N1) | Hot/cool | RT <12° C. | RT >12° C. | RT >18° C. | RT >27° C. |
|---|---|---|---|---|---|---|
| 1 | Third temperature range | Cool | +22 V | +22 V | +22 V | +22 V |
| 2 | Second temperature range | Cool | +12 V | +14 V | +16 V | +22 V |
| 3 | First temperature range | Cool | 0 V | 0 V | +12 V | +16 V |

The output of the thermoelectric element may be determined based on (a) to which of the first temperature range, the second temperature range, and the third temperature range the temperature of the storage chamber belongs.

As a voltage applied to the thermoelectric element is higher, the output of the thermoelectric element is increased. Therefore, the output of the thermoelectric element may be known from the voltage applied to the thermoelectric element. When the output of the thermoelectric element is increased, the thermoelectric element may perform stronger cooling.

In some implementations, the rotation speed of the fan is determined based on (a) to which of the first temperature range, the second temperature range and the third temperature range the temperature of the storage chamber belongs. Here, the fan refers to the first fan and/or the second fan of the thermoelectric element module.

The rotation speed of the fan may be known from the RPM of the fan per unit time. A large RPM of the fan may indicate that the fan rotates faster. When a higher voltage is applied to the fan, the RPM of the fan increases. When the fan rotates faster, heat exchange of the first heat sink and/or the second heat sink is further accelerated, so that stronger cooling may be realized.

Referring to FIG. 6, if the temperature of the storage chamber corresponds to the third temperature range, the thermoelectric element may be operated with the third output. In Table 1, the third output is +22V regardless of the external temperature. Therefore, the third output is a constant value regardless of the external temperature.

The third output (+22V) is a value that exceeds the first output (0V, +12V, +16V in Table 1) of the first temperature range. The third output is a value equal to or greater than the second output of the second temperature range (+12V, +14V, +16V, +22V in Table 1).

The third output may correspond to a maximum output of the thermoelectric element. In this case, the output of the thermoelectric element is kept constant at the maximum output in the third temperature range.

Further, if the temperature of the storage chamber corresponds to the third temperature range, the fan is rotated at the third rotation speed. Here, the third rotation speed is a value exceeding the first rotation speed of the first temperature range. The third rotation speed is a value equal to or greater than the second rotation speed of the second temperature range.

If the temperature of the storage chamber corresponds to the second temperature range, the thermoelectric element is operated with the second output. Here, the second output is not a constant value but is a value that is stepwise varied (increased) as the external temperature measured by the external air temperature sensor increases. In Table 1, the second output increases stepwise to +12V, +14V, +16V, and +22V as the external temperature increases.

The second output is a value equal to or greater than the first output of the first temperature range under the same external temperature condition. Referring to Table 1, under the condition of RT>12° C., the second output of +12V is equal to or greater than the first output of 0V. Under the condition of RT>12° C., the second output of +14V is equal to or higher than the first output of 0V. Under of condition of RT>18° C., the second output of +16V is equal to or higher the first output of +12V. Under the condition of RT>27° C., the second output of +22V is equal to or higher than the first output of +16V.

The second output is a value below the third output of the third temperature range. Referring to Table 1, the second output (+12V, +14V, +16V, +22V) is below the third output (+22V) under all external temperature conditions.

In some implementations, when the temperature of the storage chamber corresponds to the second temperature range, the fan may be rotated at the second rotation speed. Here, the second rotation speed is a value equal to or greater than the first rotation speed of the first temperature range. The second rotation speed is a value less than or equal to the third rotation speed of the third temperature range.

If the temperature of the storage chamber corresponds to the first temperature range, the thermoelectric element is operated with the first output. Here, the first output is not a constant value but is a value that is stepwise varied (increased) as the external temperature measured by the external air temperature sensor increases. However, when the external temperature is higher than the reference external temperature in the first temperature range, the first output is varied (increased) stepwise as the external temperature increases, such as 0V, +12V, and +16V. However, when the external temperature is below the reference external temperature in the first temperature range, the first output is held at 0. The operation of the thermoelectric element is maintained in a stationary state. In Table 1, the reference external temperature may be a value between 12° C. and 18° C. (for example, 15° C.).

When the first temperature range and the second temperature range in Table 1 are compared, the number of stepwise increases in the second output is greater than the number of stepwise increases in the first output in the same temperature range. The second output is changed to four levels of +12, +14, +16, and +22, but the first output changes to three levels of 0V, +12V, and +16V in the same temperature range. Accordingly, the second temperature range corresponds to the entire variable range, and the first temperature range corresponds to a partial variable range.

The first output is a value less than the second output of the second temperature range under the same external temperature condition.

Referring to Table 1, under the condition of RT<12° C., the first output of 0V is equal to or less than the second output of +12V. Under the condition of RT>12° C., the first output of 0V is equal to or less than the second output +14V. Under the condition of RT>18° C., the first output of +12V is equal or less than the second output of +16V. Under condition of RT>27° C., the first output of +16V is equal or less than the second output of +22V.

The first output is a value less than the third output of the third temperature range. Referring to Table 1, the first outputs (0V, 0V, +12V, +16V) are less than the third output (+22V) at all external temperature conditions.

The first output includes 0. When the output is 0, no voltage may be applied to the thermoelectric element so that the operation of the thermoelectric element is stopped. That is, if the temperature of the storage chamber is lowered to the set temperature input by the user, the operation of the thermoelectric element may be stopped.

In some implementations, when the temperature of the storage chamber corresponds to the first temperature range, the fan may be rotated at the first rotation speed. Here, the first rotation speed may be a value less than or equal to the second rotation speed of the second temperature range. The first rotation speed may be a value less than the third rotation speed of the third temperature range.

The first rotation speed of the fan has a value greater than 0. This is different from the first output of the thermoelectric element including 0. The fan may continue to rotate even when no voltage is applied to the thermoelectric element.

For example, when the temperature of the storage chamber is lowered under the condition of RT<12° C. to fall to enter the first temperature range from the second temperature range, a voltage may not be applied to the thermoelectric element. This is because the first output is shown as 0V in Table 1. However, even though the temperature of the storage chamber enters the first temperature range from the second temperature range, only the rotation speed of the fan is lowered and the fan still continues to rotate.

The reason is because, even though the operation of the thermoelectric element is stopped, the thermoelectric element does not immediately change to the normal temperature but maintains the cold temperature for a considerable period of time. Therefore, when the fan continues to rotate, heat exchange of the first heat sink may be continuously accelerated and the temperature of the storage chamber may be sufficiently kept in the first temperature range.

In some cases of a refrigerator having a refrigerating cycle device, the temperature range of the storage chamber may be divided into two stages (e.g., a satisfactory stage and an unsatisfactory stage), and the refrigerating cycle device may be operated only in the unsatisfactory stage to lower the temperature of the storage chamber to the set temperature. In particular, in the case of a refrigerator equipped with a refrigerating cycle device, the temperature of the storage chamber may not be divided into three levels and controlled by three stages. This is because mechanical reliability of a compressor is adversely affected if the compressor provided in the refrigerating cycle device is turned on and off too frequently. Losing reliability of the compressor may be a more fatal problem than the benefits of extending the temperature range.

In some implementations, the refrigerator having the thermoelectric element module may perform more detailed control by dividing the temperature of the storage chamber into three levels as in the control method proposed in the present disclosure. Since the thermoelectric element module is electrically turned on and off by the application of voltage, it is independent of mechanical reliability and reliability is not lost even in frequent on and off operations.

In particular, cooling performance of the thermoelectric element module does not reach the refrigerating cycle device equipped with the compressor. Therefore, when the temperature of the storage chamber rises to enter the unsatisfactory range due to the initial power-on, the stop of the driving of the thermoelectric element, or input of a load such as food to the storage chamber, it takes a long time to fall to enter the satisfactory range again. Therefore, if the temperature of the storage chamber is further defined to three levels in addition to satisfactory and dissatisfactory, it is possible to implement control for rapidly lowering the temperature of the storage chamber to the highest output from third temperature range in which the temperature is highest.

In addition, the first temperature range and the second temperature range are intended not only for cooling but also for power consumption reduction and fan noise. Since the temperature range of the storage chamber is subdivided and the temperature of the storage chamber is lowered, the output of the thermoelectric element and the rotation speed of the fan are lowered, it is possible to realize low noise of the fan as well as power consumption.

Hereinafter, a defrosting operation capable of implementing defrosting efficiency and power consumption reduction will be described.

Figure 7:
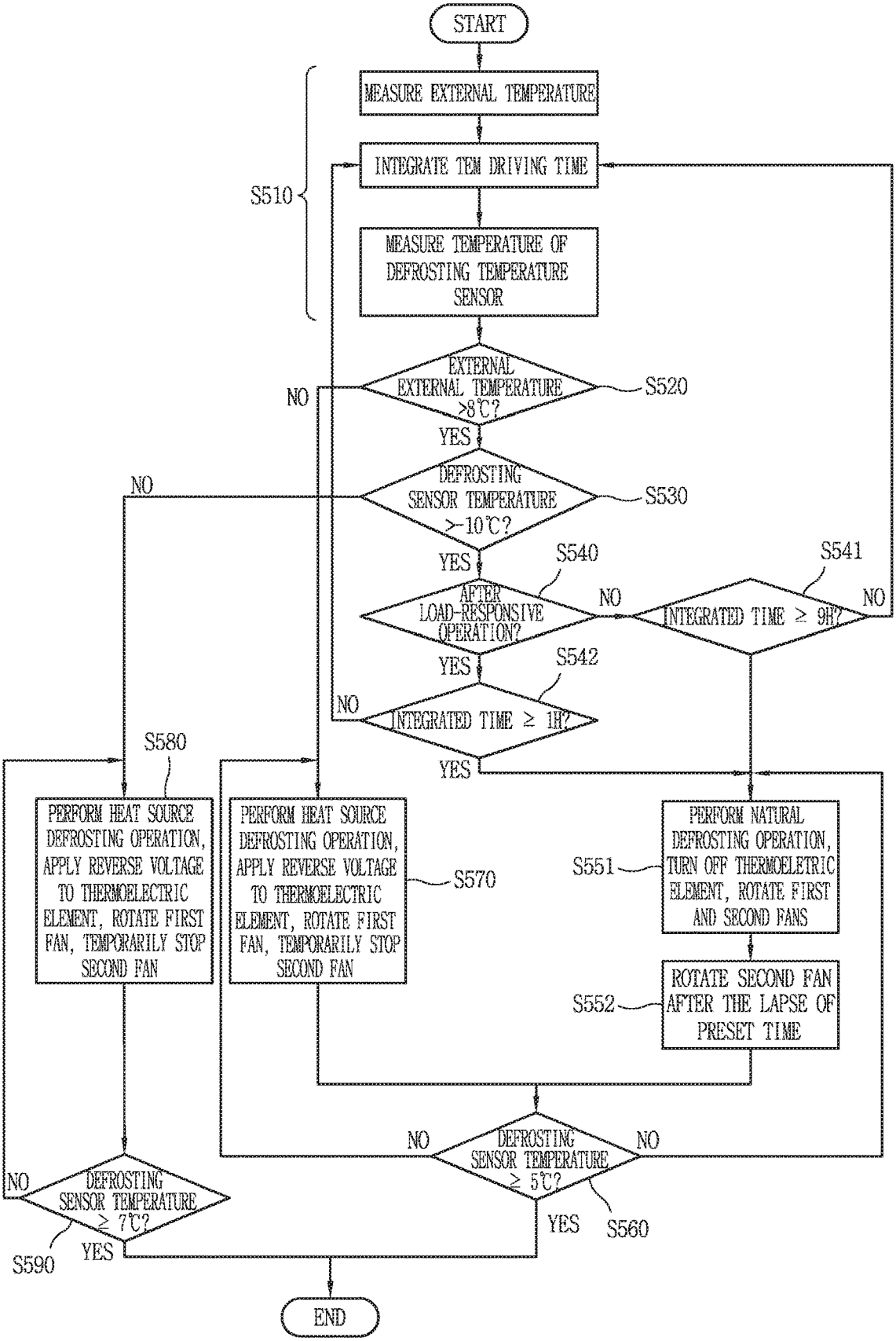
FIG. 7 is a flowchart showing an example of a defrosting operation control of a refrigerator.

FIG. 7 is a flowchart showing an example of a defrosting operation control of the refrigerator.

When the thermoelectric element module is operated cumulatively, frost is deposited on the first heat sink and the first fan. A defrosting operation refers to an operation of removing the frost.

In some implementations, the concept of the extended defrosting may enable rapid defrosting and power consumption reduction by using heat source defrosting and natural defrosting according to conditions. A heat source defrosting operation includes defrosting a thermoelectric element module by supplying energy to the thermoelectric element module, and a natural defrosting operation includes defrosting naturally without supplying energy to the thermoelectric element module. However, a heat source is also necessary for the natural defrosting operation. A heat source for the natural defrosting operation is air inside the storage chamber and waste heat of the second heat sink. In the case of the natural defrosting operation, at least one of the first fan and the second fan may be rotated.

In some cases, the natural defrosting operation rather than heat source defrosting may be performed in order to reduce power consumption of the refrigerator. Therefore, the natural defrosting operation is normally set as a basic operation, and the heat source defrosting is set as a special operation for a special case requiring rapid defrosting. In other cases, heat source defrosting may be performed rather than the natural defrosting operation.

In step S510, an operation to be preceded for the operation of the defrosting operation is to determine the necessity of the defrosting operation. First, the necessity of defrosting operation input is determined by measuring an external temperature, integrating a driving time of the thermoelectric element module, and measuring a temperature of a defrosting temperature sensor.

If the external temperature measured by the external temperature sensor is too low, if a driving time of the thermoelectric element module exceeds a preset time, or if a temperature of the thermoelectric element module measured by the defrosting temperature sensor is too low, frost is likely to be deposited on the first heat sink and the first fan. Therefore, in these cases, it may be determined that the defrosting operation is necessary.

Among them, determining to perform the defrosting operation by integrating a driving time of the thermoelectric element module is to perform the defrosting operation periodically according to a natural flow of time. In this case, it may not be considered that a relatively rapid defrosting is required. Therefore, the defrosting operation which is performed by integrating the driving of the thermoelectric element module is selected as the natural defrosting operation.

The reason why the natural defrosting operation is performed based on the time is to improve reliability of the defrosting operation. If the natural defrosting operation is performed based on a temperature, the defrosting operation may not be performed due to a small temperature difference although defrosting is already required. However, if the temperature condition is mitigated too much, the heat source defrosting may be unnecessarily performed to deteriorate power consumption even though natural defrosting operation alone is sufficient.

If the external temperature is too low or if the temperature of the thermoelectric element module is too low, there is a possibility of over-frosting and rapid defrosting is required. Therefore, the defrosting operation performed based on temperature is selected as a heat source defrosting operation. The case where rapid defrosting is required is a special case, so the heat source defrosting operation may be performed based on the temperature.

In step S520, it is determined whether the external temperature measured by the external air temperature sensor is higher or lower than a reference external temperature. The controller is configured to start the heat source defrosting operation if the external temperature measured by the external air temperature sensor is below the reference external temperature. Referring to FIG. 7, 8° C. is selected as an example of the reference external temperature.

An external temperature exceeding 8° C. may be relatively warm. Frost is not easily deposited in a warm environment. Therefore, the heat source defrosting operation is performed only when the external temperature is 8° C. or lower (NO).

In step S530, it is determined whether the temperature of the thermoelectric element module measured by the defrosting temperature sensor is higher or lower than the reference thermoelectric element module temperature. The controller is configured to perform the heat source defrosting operation if the temperature of the thermoelectric element module measured by the defrosting temperature sensor is below the reference thermoelectric element module temperature. Referring to FIG. 7, −10° C. is selected as an example of the reference thermoelectric element module temperature.

If the temperature of the thermoelectric element module exceeds −10° C., the temperature of the thermoelectric element module may be not excessively low. If the temperature of the thermoelectric element module is not excessively low, the frost is not easily deposited. Therefore, the heat source defrosting operation is performed only when the temperature of the thermoelectric element module is −10° C. or lower (NO).

In step S540, if the heat source defrosting operation is not performed, a driving time of the thermoelectric element module is integrated and the natural defrosting operation is performed at every preset period. The controller is configured to perform the natural defrosting operation for removing frost that is deposited on the thermoelectric element module at preset intervals based on the driving integration time of the thermoelectric element module. However, the preset period for determining to perform the natural defrosting operation is changed based on whether or not the door is opened as in the case of the load-responsive operation. Accordingly, in order to determine the preset period, it is first determined whether the door is opened such as the load-responsive operation before the natural defrosting operation is started.

In step S541, if it is not after the load-responsive operation or if there is no preceding opening of the door (NO), it is determined whether or not the integration time has reached a period set as a default value. In FIG. 7, 9 hours is selected as an example of the default value. When the integration time reaches 9 hours, the natural defrosting operation is started.

In step S542, if it is after the load-responsive operation, the integration time is changed to a shorter value than the period set as the default value. In FIG. 7, one hour is selected as an example of the time shorter than the default value. There are many factors that cause the integration time to change to a short value.

First, it is opening of the door. The preset period for determining to perform the natural defrosting operation may be reduced to a value shorter before opening of the door due to the opening of the door.

Second, it is an opening time of the door. The preset period for determining to perform the natural defrosting operation may be shortened in inverse proportion to an opening time of the door. For example, the period per second of an opening time of the door may be reduced by 7 minutes each time.

Third, it is the starting of the load-responsive operation. When the temperature of the storage chamber rises by a preset temperature within a preset time after the door is opened and then closed, the controller is configured to perform the load-responsive operation to lower the temperature of the storage chamber. When the load-responsive operation is started, the preset period for determining the starting of the natural defrosting operation is reduced to a value shorter than that before the starting of the load-responsive operation.

According to these factors, there is a high possibility that the thermoelectric element module operates at the maximum output after opening and closing the door. This is because the opening of the door and the load-responsive operation require the temperature of the storage chamber to be lowered. After operating the thermoelectric element module at the maximum output, frost is easily deposited, so rapid defrosting must be done. Therefore, if these factors exist prior to the starting of the natural defrosting operation, the integration time for determining the starting of the natural defrosting operation should be changed to a value shorter than the default value.

In step S551, when the natural defrosting operation is started, the operation of the thermoelectric element is stopped. The voltage supplied to the thermoelectric element becomes 0V. However, the voltage supplied to the thermoelectric element is not rapidly changed to 0V, and the thermoelectric element module performs a pre-cooling operation. In some examples, in the pre-cooling operation, power of the thermoelectric element module may not be immediately cut off, but the output of the thermoelectric element may be sequentially reduced to converge to zero.

When the natural defrosting operation is started, the first fan is continuously rotated and the second fan is temporarily stopped. Since the frost is deposited on the first heat sink and the first fan, which are kept at low temperatures during the cooling operation, the rotation of the first fan must be maintained during the natural defrosting operation. This is to remove the frost by accelerating heat exchange of the first heat sink.

In some implementations, frost may be not easily deposited in the second fan. The second fan corresponds to a heat dissipation side of the thermoelectric element. Therefore, rotation of the second fan during the natural defrosting operation wastes power consumption without any special effect. The rotation of the second fan is temporarily stopped until the frost melts to reduce power consumption.

In step S552, the second fan is rotated again after the lapse of a preset time.

Once the natural defrosting operation is started, the frost is removed within 3 to 4 minutes. While the frost melts, condensate may be formed in the first heat sink and the first fan or dew may be formed in the second heat sink and the second fan. Condensate generated in the first heat sink and the first fan is removed by rotation of the first fan. The dew formed in the second heat sink and the second fan is removed by rotation of the second fan.

Condensate and dew should also be removed to ensure perfect completion of the natural defrosting operation because they cause frost deposition. Therefore, if the frost is removed within 3 to 4 minutes, the preset time may be 5 minutes, for example.

Since the voltage is not applied to the thermoelectric element during the natural defrosting operation, power consumption of the thermoelectric element may be reduced. In addition, since the second fan is temporarily stopped and then rotated again, power consumption may be further reduced while the rotation of the second fan is stopped.

In step S560, when the temperature of the thermoelectric element module measured by the defrosting temperature sensor reaches a reference defrosting termination temperature, the controller terminates the natural defrosting operation. As illustrated in FIG. 7, the reference defrosting termination temperature may be 5° C.

The termination of the natural defrosting operation is determined based on a temperature. This is the same with the case of the heat source defrosting operation described later. The reason that the termination of the defrosting operation is based on a temperature is to improve reliability of the defrosting operation.

In some cases, where the defrosting operation is terminated based on time, the defrosting operation may be terminated before the defrosting is completed. For instance, two refrigerators may be installed in different environments and terminate the defrosting operation according to the same time condition. In some cases, defrosting may be completed in one of the refrigerators, and defrosting in the other one of the refrigerators is not completed yet, which may cause scattering. In some implementations, for example to avoid or reduce scattering, the defrosting operation may be terminated based on a temperature.

In step S570, if the external temperature is below the reference external temperature, the heat source defrosting operation is started. The controller may be configured to perform the heat source defrosting operation if the external temperature of the refrigerator measured by the external air temperature sensor is below the reference external temperature.

When the heat source defrosting operation is started, a reverse voltage is applied to the thermoelectric element. For example, a voltage of −10V may be applied to the thermoelectric element. Also, the first fan and the second fan are rotated throughout the heat source defrosting operation.

When the reverse voltage is applied to the thermoelectric element, a heat absorption side and a heat dissipation side of the thermoelectric element module are exchanged with each other. For example, the first heat sink and the first fan serve as the heat dissipation side of the thermoelectric element module, and the second heat sink and the second fan serve as the heat absorption side of the thermoelectric element module. Since the first heat sink is warmed, frost deposited on the first heat sink may be removed.

When the reverse voltage is applied to the thermoelectric element, a temperature difference is generated on one side and the other side of the thermoelectric element. Accordingly, heat exchange of the first heat sink and the second heat sink must be accelerated, while the first fan and the second fan continuously rotate, to quickly remove frost.

In step S560, when the temperature of the thermoelectric element module measured by the defrosting temperature sensor reaches the reference defrosting termination temperature, the controller terminates the heat source defrosting operation. As illustrated in FIG. 7, the reference defrosting termination temperature may be 5° C.

In step S580, if the temperature of the thermoelectric element module is below the reference thermoelectric element module temperature, the heat source defrosting operation is started. The controller is configured to perform the heat source defrosting operation if the temperature of the thermoelectric element module measured by the defrosting temperature sensor is below the reference thermoelectric element module temperature.

As described above, similarly, when the heat source defrosting operation is started, a reverse voltage is applied to the thermoelectric element. For example, a voltage of −10V may be applied to the thermoelectric element. Also, the first fan and the second fan are rotated throughout the heat source defrosting operation.

In step S590, when the temperature of the thermoelectric element module measured by the defrosting temperature sensor reaches a temperature higher than the reference defrosting termination temperature by a preset width, the controller terminates the heat source defrosting operation. As illustrated in FIG. 7, the temperature which is higher than the reference defrosting termination temperature by the preset width may be 7° C.

In some cases, when the temperature of the thermoelectric element module is below the reference thermoelectric element module temperature, over-frosting may be easily formed. Therefore, the heat source defrosting operation must be terminated at a temperature higher than the termination temperature of the natural defrosting operation, to enhance reliability of the defrosting operation.

Hereinafter, the operation of the thermoelectric element, the first fan, and the second fan during the natural defrosting operation and the heat source defrosting operation will be described.

Figure 8:
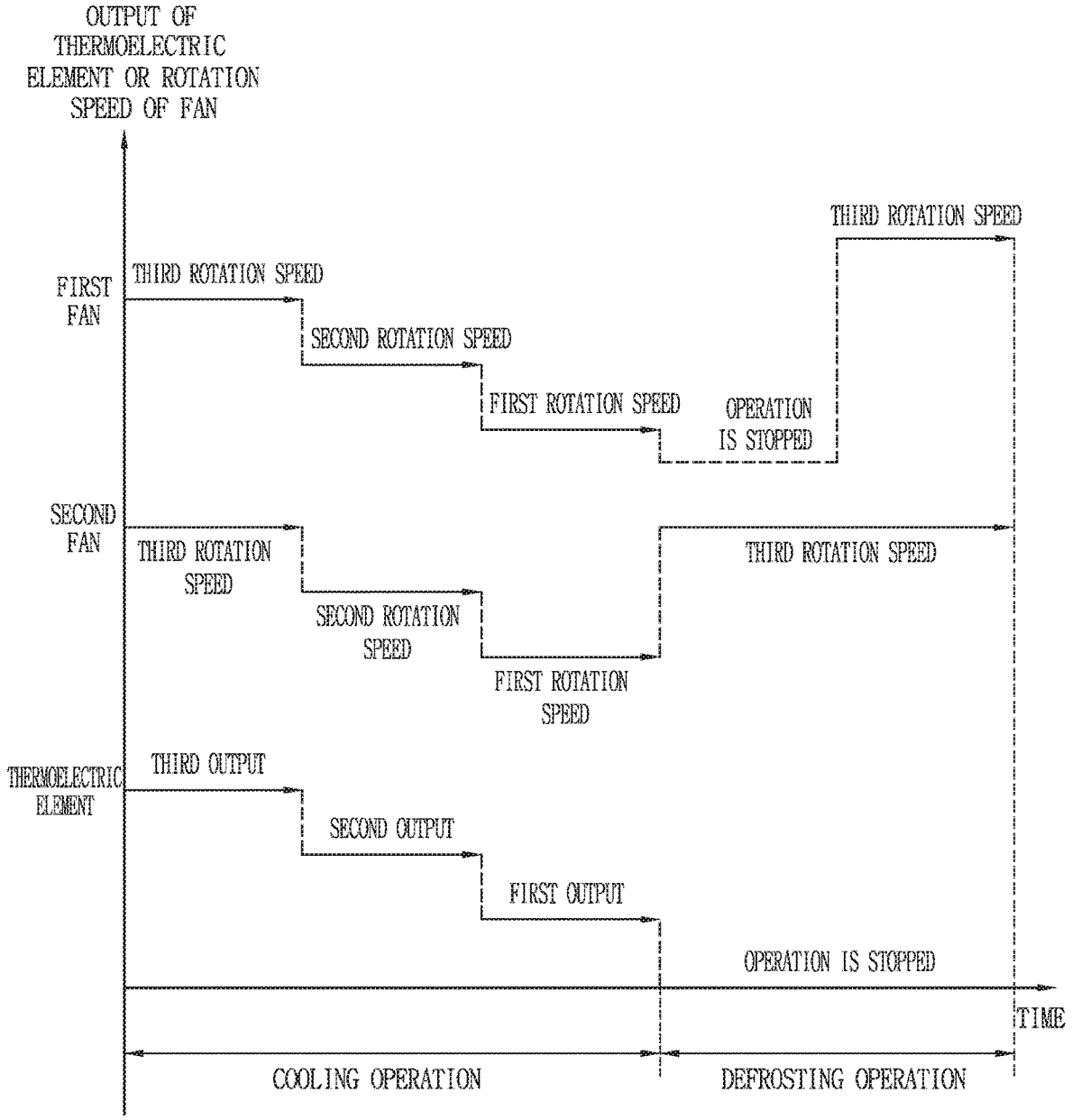
FIG. 8 is a conceptual view showing examples of an output of a thermoelectric element, a rotation speed of a first fan, and a rotation speed of a second fan in accordance with a cooling operation and a natural defrosting operation over time.

FIG. 8 is a conceptual view showing an example of an output of a thermoelectric element, a rotation speed of a first fan, and a rotation speed of a second fan in accordance with a cooling operation and a natural defrosting operation over time.

The horizontal axis reference line refers to time and the vertical axis reference line refers to output of the thermoelectric element or a rotation speed of the first fan and the second fan.

In the cooling operation, the third temperature range, the second temperature range, and the first temperature range are sequentially shown. The output of the thermoelectric element during the cooling operation and the rotation speed of the first fan and the second fan are determined based on a temperature of the storage chamber measured by the internal temperature sensor.

In the third temperature range, the thermoelectric element operates at the third output, the first fan rotates at the third rotation speed, and the second fan also rotates at the third rotation speed. However, the third rotation speed of the first fan and the third rotation speed of the second fan are different from each other, and the rotation speed of the second fan is faster.

Subsequently, in the second temperature range, the thermoelectric element operates at the second output, the first fan rotates at the second rotation speed, and the second fan also rotates at the second rotation speed. However, the second rotation speed of the first fan and the second rotation speed of the second fan are different from each other, and the rotation speed of the second fan is faster.

Next, in the first temperature range, the thermoelectric element operates at the first output, the first fan rotates at the first rotation speed, and the second fan rotates at the first rotation speed. However, the first rotation speed of the first fan and the first rotation speed of the second fan are different from each other, and the rotation speed of the second fan is faster.

When the natural defrosting operation is started, the operation of the thermoelectric element is stopped. The first fan is rotated at the third rotation speed. The rotation of the second fan is temporarily stopped and then rotated at the third rotation speed after the lapse of a preset time.

Accordingly, the rotation speed of the first fan during the defrosting operation is equal to or greater than the rotation speed of the first fan during the cooling operation. The rotation speed of the first fan during the defrosting operation and a maximum rotation speed of the first fan during the cooling operation may be equal to each other.

The rotation speed of the second fan during the defrosting operation is equal to or greater than the rotation speed of the second fan during the cooling operation. The rotation speed of the second fan during the defrosting operation and a maximum rotation speed of the second fan during the cooling operation may be equal to each other.

Figure 9:
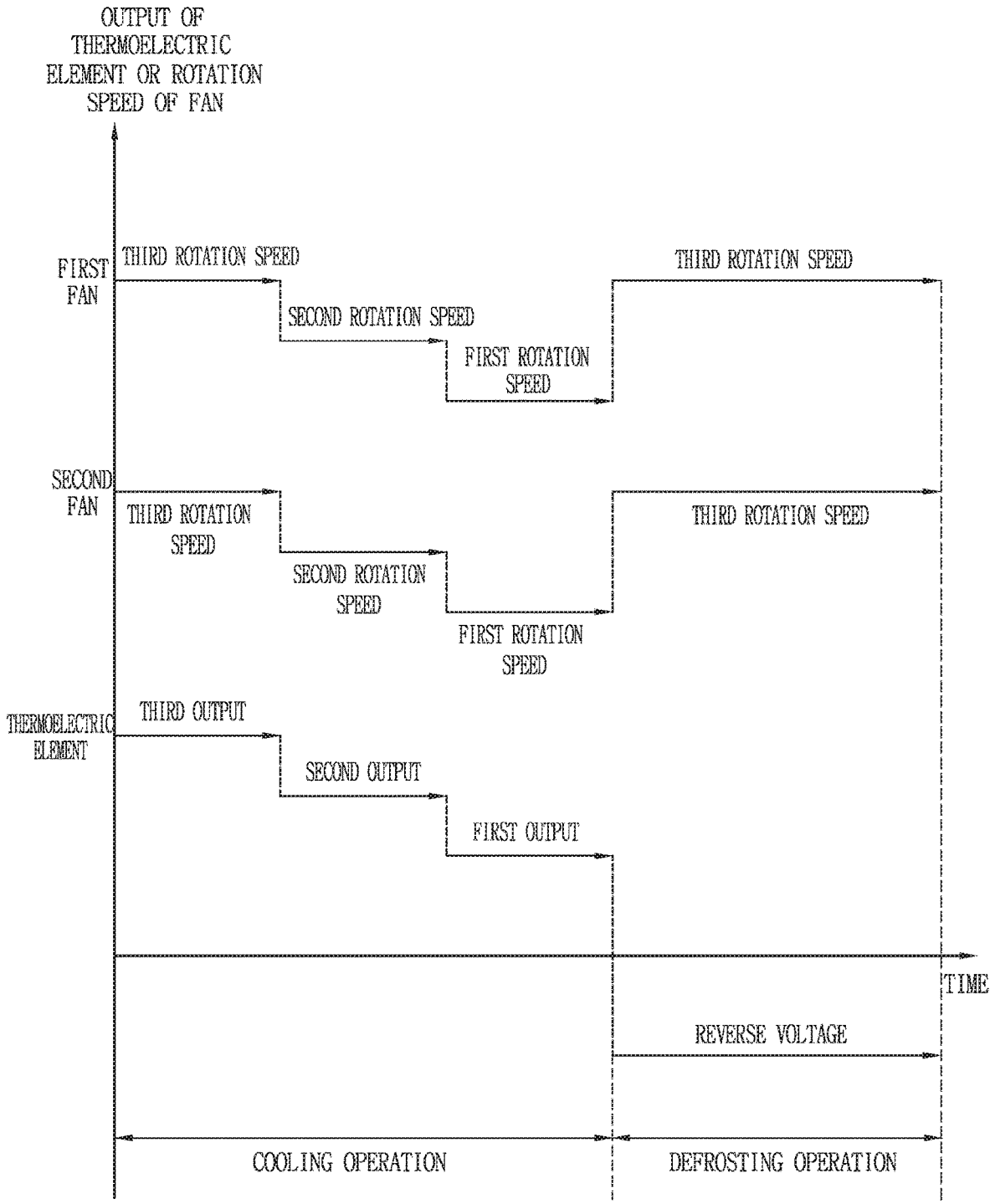
FIG. 9 is a conceptual diagram showing examples of an output of the thermoelectric element, a rotation speed of the first fan, and a rotation speed of the second fan in accordance with a cooling operation and a heat source defrosting operation.

FIG. 9 is a conceptual diagram showing an example of an output of the thermoelectric element, a rotation speed of the first fan, and a rotation speed of the second fan in accordance with a cooling operation and a heat source defrosting operation.

A description of the cooling operation is replaced with the description of FIG. 8. The output of the thermoelectric element and the rotation speed of the fan are determined based on the temperature of the storage chamber measured by the internal temperature sensor.

When the heat source defrosting operation is started, a reverse voltage is applied to the thermoelectric element. Also, each of the first fan and the second fan are rotated at the third rotation speed. The third rotation speed of the first fan and the third rotation speed of the second fan are different from each other and the rotation speed of the second fan is faster.

Therefore, the rotation speed of the fan during the defrosting operation is faster in the defrosting operation than during the cooling operation. During the defrosting operation, the rotation speed of the fan may be equal to a maximum rotation speed of the fan during the cooling operation.

Next, the load-responsive operation as a basis for a change in an integration time will be described.

Figure 10:
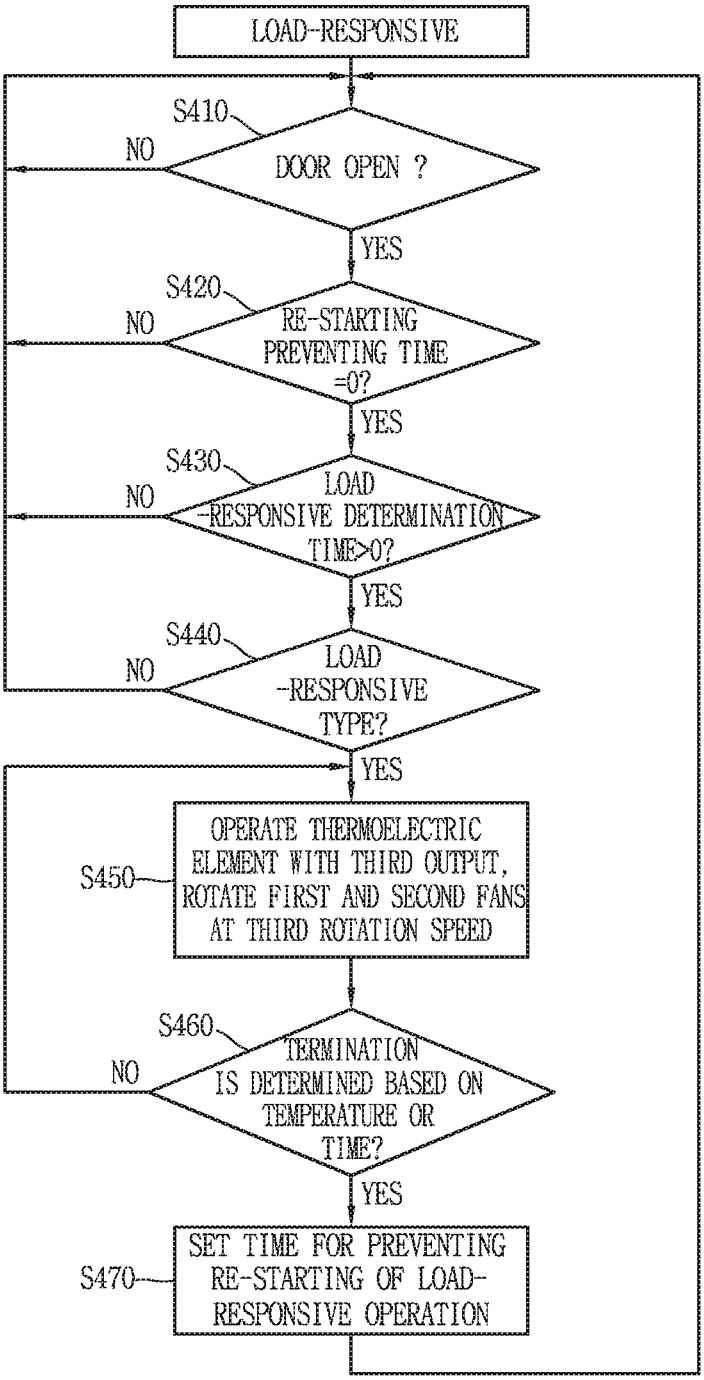
FIG. 10 is a flowchart showing an example of a load-responsive operation control of a refrigerator having a thermoelectric element module.

FIG. 10 is a flowchart showing an example of a load-responsive operation control of a refrigerator having a thermoelectric element module.

In step S410, first, it is detected whether the door is opened or closed. A load may refer to an amount of cooling power or an event in which the storage chamber needs to be cooled promptly due to the opening of the door or an input of food after opening the door. Therefore, whether or not the load-responsive operation is started may be determined after the door is opened.

In step S420, if it is detected that the door has been opened and closed, it is determined whether or not a re-input preventing time of the load-responsive operation has reached 0. In some examples, once the load-responsive operation is completed, even though a situation requiring cooling of the storage chamber may occur again, the load-responsive operation may not be re-started immediately but instead may be started after the lapse of a preset time. This can help prevent supercooling. When the preset time is counted and reaches 0, the load-responsive operation may be restarted.

In step S430, it is checked whether a load-responsive determination time is greater than 0. The load-responsive operation may be started after the door is opened and then closed. For example, if the temperature in the storage chamber rises by 2° C. or more within 5 minutes after the door is closed, the load-responsive operation may be started. Since the load-responsive determination time is counted after the door is closed, even though the temperature of the storage chamber rises by 2° C. or more than before the door is opened, the load-responsive operation is not started because the load-responsive determination time is 0 if the door is not closed yet When the temperature of the storage chamber rises by a preset temperature within a preset time after the door is opened and then closed, the controller performs the load-responsive operation.

In step S440, a type of the load-responsive operation is determined.

A first load-responsive operation is started when hot food is introduced into the storage chamber and rapid cooling is required. For example, the first load-responsive operation is started when the temperature of the storage chamber rises by 2° C. or more within 5 minutes after the door is opened and then closed.

A second load-responsive operation is performed when the temperature is not so high but food having a large heat capacity is put in and continuous cooling is required. For example, the second load-responsive operation is started when the temperature of the storage chamber rises by 8° C. or more with respect to a set temperature input by the user within 20 minutes after the door is opened and then closed. If it is determined to be the first load-responsive operation, the first load-responsive operation is not started.

If neither the first load-responsive operation nor the second load-responsive operation is not required, the controller does not perform the load-responsive operation.

In step S450, the load-responsive operation is configured such that the thermoelectric element is operated with the third output regardless of the temperature of the storage chamber belonging to the first temperature range, the second temperature range and the third temperature range. The third output may correspond to the maximum output of the thermoelectric element.

When the load-responsive operation is required, the temperature of the storage chamber may be already entered or correspond to the third temperature range, and thus the thermoelectric element may be operated as the third output for rapid cooling.

Also, the load-responsive operation is configured such that the fan is rotated at the third rotation speed regardless of whether the temperature of the storage chamber belongs to the first temperature range, the second temperature range, or the third temperature range. However, the third rotation speed of the first fan and the third rotation speed of the second fan are different from each other, and the second fan rotates at a higher speed than the first fan.

In some examples, when the load-responsive operation is required, the temperature of the storage chamber may be already entered the third temperature range or highly likely to enter the third temperature range, so that the fan is rotated at the third rotation speed for rapid cooling. This is for reducing fan noise.

In step S460, the load-responsive operation is completed based on temperature or time. For example, the load-responsive operation may be completed when the temperature of the storage chamber is lower than the preset temperature by a preset temperature or after the lapse of a preset time since the load-responsive operation was started.

In step S470, finally, the time for preventing restarting of the load-responsive operation is initialized and counted again.

The refrigerator described above is not limited to the configuration and the method of the implementations described above and all or some of the implementations may be combined to be variously modified.

The present disclosure may be applied to industrial fields related to a thermoelectric element module and a refrigerator including the thermoelectric element module.

The invention claimed is:

1. A refrigerator comprising:

a door configured to open and close a storage chamber of the refrigerator;

a thermoelectric element module configured to cool the storage chamber;

a defrosting temperature sensor installed in the thermoelectric element module and configured to detect a temperature of the thermoelectric element module; and a controller configured to control operation of the thermoelectric element module, wherein the thermoelectric element module comprises:

a thermoelectric element comprising a heat absorption portion and a heat dissipation portion, a first heat sink that is in contact with the heat absorption portion and that is configured to exchange heat with an inside of the storage chamber, a first fan that faces the first heat sink and that is configured to generate air flow to accelerate heat exchange of the first heat sink, a second heat sink that is in contact with the heat dissipation portion and that is configured to exchange heat with an outside of the storage chamber, and a second fan that faces the second heat sink and that is configured to generate air flow to accelerate heat exchange of the second heat sink, wherein the controller is configured to:

initiate a natural defrosting operation for removing frost deposited on the thermoelectric element module at every preset period determined based on an accumulated driving duration of the thermoelectric element module, and terminate the natural defrosting operation based on the temperature of the thermoelectric element module measured by the defrosting temperature sensor corresponding to a reference defrosting termination temperature, and wherein the controller is configured to, based on initiating the natural defrosting operation, (i) stop operation of the thermoelectric element, (ii) maintain rotation of the first fan, and (iii) stop rotation of the second fan for a preset time and then rotate the second fan after a lapse of the preset time.

2. The refrigerator of claim 1, further comprising:

an external air temperature sensor configured to measure an external temperature of the refrigerator, wherein the thermoelectric element is configured to cool the storage chamber based on a forward voltage, wherein the controller is further configured to:

initiate a heat source defrosting operation based on the external temperature measured by the external air temperature sensor being less than or equal to a reference external temperature, and terminate the heat source defrosting operation based on the temperature of the thermoelectric element module measured by the defrosting temperature sensor corresponding to the reference defrosting termination temperature, and wherein the controller is further configured to, based on initiating the heat source defrosting operation, apply a reverse voltage to the thermoelectric element and rotate both of the first fan and the second fan.

3. The refrigerator of claim 2, wherein the preset period for determining the initiation of the natural defrosting operation decreases based on an increase of an opening time of the door in which the door is opened.

4. The refrigerator of claim 2, wherein the preset period for determining the initiation of the natural defrosting operation is set to a value based on the door being opened, the value being less than a prior value set before the opening of the door.

5. The refrigerator of claim 2, further comprising an internal temperature sensor configured to measure a temperature of the storage chamber, wherein the controller is further configured to:

determine a cooling rotation speed of the first fan and a cooling rotation speed of the second fan during a cooling operation for cooling the storage chamber based on a temperature condition of the storage chamber measured by the internal temperature sensor, rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan, and rotate the second fan at a second rotation speed (i) during the natural defrosting operation or (ii) during the heat source defrosting operation, the second rotation speed being greater than or equal to the cooling rotation speed of the second fan.

6. The refrigerator of claim 5, wherein the first rotation speed of the first fan during the natural defrosting operation or the heat source defrosting operation is equal to a maximum rotation speed of the first fan during the cooling operation, and wherein the second rotation speed of the second fan during the natural defrosting operation or the heat source defrosting operation is equal to a maximum rotation speed of the second fan during the cooling operation.

7. The refrigerator of claim 1, wherein the thermoelectric element is configured to cool the storage chamber based on a forward voltage, and wherein the controller is further configured to:

initiate a heat source defrosting operation based on the temperature of the thermoelectric element module measured by the defrosting temperature sensor being less than or equal to a reference thermoelectric element module temperature, and terminate the heat source defrosting operation based on the temperature of the thermoelectric element module measured by the defrosting temperature sensor corresponding to a temperature greater than the reference defrosting termination temperature by a preset threshold, and wherein the controller is configured to, based on initiating the heat source defrosting operation, apply a reverse voltage to the thermoelectric element and rotate both of the first fan and the second fan.

8. The refrigerator of claim 7, further comprising an internal temperature sensor configured to measure a temperature of the storage chamber, wherein the controller is further configured to:

determine a cooling rotation speed of the first fan and a cooling rotation speed of the second fan during a cooling operation for cooling the storage chamber based on a temperature condition of the storage chamber measured by the internal temperature sensor, rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan, and rotate the second fan at a second rotation speed (i) during the natural defrosting operation or (ii) during the heat source defrosting operation, the second rotation speed being greater than or equal to the cooling rotation speed of the second fan.

9. The refrigerator of claim 8, wherein the first rotation speed of the first fan during the natural defrosting operation or the heat source defrosting operation is equal to a maximum rotation speed of the first fan during the cooling operation, and wherein the second rotation speed of the second fan during the natural defrosting operation or the heat source defrosting operation is equal to a maximum rotation speed of the second fan during the cooling operation.

10. The refrigerator of claim 7, wherein the preset period for determining the initiation of the natural defrosting operation decreases based on an increase of an opening time of the door in which the door is opened.

11. The refrigerator of claim 1, wherein the controller is further configured to initiate a load-responsive operation for decreasing the temperature of the storage chamber based on the temperature of the storage chamber being increased by a preset temperature within a preset time after the door is opened and then closed, and wherein the preset period for determining the initiation of the natural defrosting operation is set to a value based on initiation of the load-responsive operation, the value being less than a prior value set before the initiation of the load-responsive operation.

12. The refrigerator of claim 1, wherein the preset period for determining the initiation of the natural defrosting operation varies based on whether or not the door is opened.

13. The refrigerator of claim 12, wherein the preset period for determining the initiation of the natural defrosting operation decreases based on an increase of an opening time of the door in which the door is opened.

14. The refrigerator of claim 12, wherein the preset period for determining the initiation of the natural defrosting operation is set to a value based on the door being opened, the value being less than a prior value set before the opening of the door.

15. A refrigerator comprising:

a door configured to open and close a storage chamber of the refrigerator;

a thermoelectric element module configured to cool the storage chamber;

a defrosting temperature sensor installed in the thermoelectric element module and configured to detect a temperature of the thermoelectric element module;

an external air temperature sensor configured to measure an external temperature of the refrigerator; and a controller configured to control operation of the thermoelectric element module, wherein the thermoelectric element module comprises:

a thermoelectric element comprising a heat absorption portion and a heat dissipation portion and being configured to cool the storage chamber based on a forward voltage, a first heat sink that is in contact with the heat absorption portion and that is configured to exchange heat with an inside of the storage chamber, a first fan that faces the first heat sink and that is configured to generate air flow to accelerate heat exchange of the first heat sink, a second heat sink that is in contact with the heat dissipation portion and that is configured to exchange heat with an outside of the storage chamber, and a second fan that faces the second heat sink and that is configured to generate air flow to accelerate heat exchange of the second heat sink, wherein the controller is configured to:

initiate a natural defrosting operation for removing frost deposited on the thermoelectric element module at every preset period determined based on an accumulated driving duration of the thermoelectric element module, and terminate the natural defrosting operation based on the temperature of the thermoelectric element module measured by the defrosting temperature sensor corresponding to a reference defrosting termination temperature, wherein the controller is further configured to, based on initiating the natural defrosting operation, (i) stop operation of the thermoelectric element and (ii) rotate both of the first fan and the second fan, wherein the preset period for determining the initiation of the natural defrosting operation varies based on whether or not the door is opened, wherein the controller is further configured to:

initiate a heat source defrosting operation based on the external temperature measured by the external air temperature sensor being less than or equal to a reference external temperature, and terminate the heat source defrosting operation based on the temperature of the thermoelectric element module measured by the defrosting temperature sensor corresponding to the reference defrosting termination temperature, and wherein the controller is configured to, based on initiating the heat source defrosting operation, apply a reverse voltage to the thermoelectric element and rotate both of the first fan and the second fan.

16. The refrigerator of claim 15, further comprising an internal temperature sensor configured to measure a temperature of the storage chamber, wherein the controller is further configured to:

determine a cooling rotation speed of the first fan and a cooling rotation speed of the second fan during a cooling operation for cooling the storage chamber based on a temperature condition of the storage chamber measured by the internal temperature sensor, rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan, and rotate the second fan at a second rotation speed (i) during the natural defrosting operation or (ii) during the heat source defrosting operation, the second rotation speed being greater than or equal to the cooling rotation speed of the second fan.

17. The refrigerator of claim 16, wherein the first rotation speed of the first fan during the natural defrosting operation or the heat source defrosting operation is equal to a maximum rotation speed of the first fan during the cooling operation, and wherein the second rotation speed of the second fan during the natural defrosting operation or the heat source defrosting operation is equal to a maximum rotation speed of the second fan during the cooling operation.

18. A refrigerator comprising:

a door configured to open and close a storage chamber of the refrigerator;

a thermoelectric element module configured to cool the storage chamber;

a defrosting temperature sensor installed in the thermoelectric element module and configured to detect a temperature of the thermoelectric element module; and a controller configured to control operation of the thermoelectric element module, wherein the thermoelectric element module comprises:

a thermoelectric element comprising a heat absorption portion and a heat dissipation portion and being configured to cool the storage chamber based on a forward voltage, a first heat sink that is in contact with the heat absorption portion and that is configured to exchange heat with an inside of the storage chamber, a first fan that faces the first heat sink and that is configured to generate air flow to accelerate heat exchange of the first heat sink, a second heat sink that is in contact with the heat dissipation portion and that is configured to exchange heat with an outside of the storage chamber, and a second fan that faces the second heat sink and that is configured to generate air flow to accelerate heat exchange of the second heat sink, wherein the controller is configured to:

initiate a natural defrosting operation for removing frost deposited on the thermoelectric element module at every preset period determined based on an accumulated driving duration of the thermoelectric element module, and terminate the natural defrosting operation based on the temperature of the thermoelectric element module measured by the defrosting temperature sensor corresponding to a reference defrosting termination temperature, wherein the controller is further configured to, based on initiating the natural defrosting operation, (i) stop operation of the thermoelectric element and (ii) rotate both of the first fan and the second fan, wherein the preset period for determining the initiation of the natural defrosting operation varies based on whether or not the door is opened, wherein the controller is further configured to:

initiate a heat source defrosting operation based on the temperature of the thermoelectric element module measured by the defrosting temperature sensor being less than or equal to a reference thermoelectric element module temperature, and terminate the heat source defrosting operation based on the temperature of the thermoelectric element module measured by the defrosting temperature sensor corresponding to a temperature greater than the reference defrosting termination temperature by a preset threshold, and wherein the controller is further configured to, based on initiating the heat source defrosting operation, apply a reverse voltage to the thermoelectric element and rotate both of the first fan and the second fan.

19. The refrigerator of claim 18, further comprising an internal temperature sensor configured to measure a temperature of the storage chamber, wherein the controller is further configured to:

determine a cooling rotation speed of the first fan and a cooling rotation speed of the second fan during a cooling operation for cooling the storage chamber based on a temperature condition of the storage chamber measured by the internal temperature sensor, rotate the the first fan at a first rotation speed (i) during the natural defrosting operation in which the operation of the thermoelectric element is stopped or (ii) during the heat source defrosting operation in which the reverse voltage is to the thermoelectric element, the first rotation speed being greater than or equal to the cooling rotation speed of the first fan, and rotate the second fan at a second rotation speed (i) during the natural defrosting operation or (ii) during the heat source defrosting operation, the second rotation speed being greater than or equal to the cooling rotation speed of the second fan.

20. The refrigerator of claim 19, wherein the first rotation speed of the first fan during the natural defrosting operation or the heat source defrosting operation is equal to a maximum rotation speed of the first fan during the cooling operation, and wherein the second rotation speed of the second fan during the natural defrosting operation or the heat source defrosting operation is equal to a maximum rotation speed of the second fan during the cooling operation.

* * * * *